US006487719B1

(12) United States Patent
Itoh et al.

(10) Patent No.: US 6,487,719 B1
(45) Date of Patent: Nov. 26, 2002

(54) METHOD AND APPARATUS FOR MONITORING TV CHANNEL SELECTING STATUS

(75) Inventors: Yosikazu Itoh, Tokyo (JP); Hiroshi Tanaka, Tokyo (JP)

(73) Assignee: K. K. Video Research, Tokyo (JP)

( * ) Notice: Subject to any disclaimer, the term of this patent is extended or adjusted under 35 U.S.C. 154(b) by 0 days.

(21) Appl. No.: 09/273,733

(22) Filed: Mar. 22, 1999

(30) Foreign Application Priority Data

Mar. 23, 1998 (JP) ..... 10-093982

(51) Int. Cl.[7] ..... H04H 9/00; H04H 7/16; H04H 17/00; H04H 17/02

(52) U.S. Cl. ..... 725/17; 725/14; 348/194

(58) Field of Search ..... 725/14, 17, 31; 348/194

(56) References Cited

U.S. PATENT DOCUMENTS 4,388,644 A * 6/1983 Ishman et al. ..... 725/17
4,847,685 A * 7/1989 Gall et al. ..... 725/14
5,294,981 A * 3/1994 Yazolino et al. ..... 725/17
5,608,445 A * 3/1997 Mischler ..... 725/17
5,889,548 A * 3/1999 Chan ..... 725/17
6,112,053 A * 8/2000 Dunki-Jacobs et al. ..... 725/17

* cited by examiner

*Primary Examiner*—John Miller
*Assistant Examiner*—Scott Beliveau
(74) *Attorney, Agent, or Firm*—Sughrue Mion, PLLC

(57) ABSTRACT

A monitoring apparatus connected to a TV set selects, from a plurality of internal sources, such as VHF/UHF and BS tuners and built in said TV, and a plurality of external sources connected to the TV set from the outside thereof, such as a CATV tuner and a VCR, the source of video currently displayed on a cathode-ray tube of the TV set by comparing a sync signal of the video signal applied to the cathode-ray tuber and a sync signal of the video signal output from each source. Then the monitoring apparatus determines the currently selected channel by comparing a sync signal of the video signal output from the currently selected source and a sync signal of a video signal of each of broadcast channels generated by reference receivers in the monitoring apparatus independently of the TV set. When the channels cannot be narrowed down to one currently selected channel by the comparison of sync signals, the video signals output from the currently selected source are compared with the video signals of the broadcast channels generated by the receivers to determine one of the channels as being currently selected.

10 Claims, 21 Drawing Sheets

FIG. 5A

22621a SOURCE ENVIRONMENT TABLE

| SOURCE | ANALOG SWITCH INPUT |
|---|---|
| TV-BUILT-IN VHF/UHF TUNER | I1 |
| TV-BUILT-IN BS TUNER | I2 |
| CSTV TUNER | I3 |
| CATV TUNER | I4 |
| VCR-BUILT-IN VHF/UHF TUNER | I5 |

FIG. 5B

22621b

| | |
|---|---|
| NON INTERLACED EQUIPMENT | ELECTRONIC GAME MACHINE |

FIG. 6

22622-1

LIST OF CHANNELS RECEIVABLE BY TV-BUILT-IN VHF/UHF TUNER 22622-2

LIST OF CHANNELS RECEIVABLE BY TV-BUILT-IN BS TUNER 22622-3

LIST OF CHANNELS RECEIVABLE BY CSTV TUNER 22622-4

LIST OF CHANNELS RECEIVABLE BY CATV TUNER 22622-5

LIST OF CHANNELS RECEIVABLE BY VCR-BUILT-IN VHF/UHF TUNER

FIG. 7

22622-4

| RECEIVABLE CATV CHANNEL | SCRAMBLED OR NONSCRAMBLED |
|---|---|
| C1 | 0 |
| C2 | 1 |
| ⋮ | ⋮ |

FIG. 8

22623

| SOURCE | DELAY TIME RELATIVE TO SYNC SIG. FROM TV CATHODE-RAY TUBE |
|---|---|
| TV-BUILT-IN VHF/UHF TUNER | t11 |
| TV-BUILT-IN BS TUNER | t12 |
| CSTV TUNER | t13 |
| CATV TUNER | t14 |
| VCR-BUILT-IN VHF/UHF TUNER | t15 |

FIG. 9

22624

| SOURCE | DELAY TIME RELATIVE TO SYNC SIG. FROM IMAGE RECEIVER OF MONITORING APPARATUS |
|---|---|
| TV-BUILT-IN VHF/UHF TUNER | t21 |
| TV-BUILT-IN BS TUNER | t22 |
| CSTV TUNER | t23 |
| CATV TUNER | t24 |
| VCR-BUILT-IN VHF/UHF TUNER | t25 |

METHOD AND APPARATUS FOR MONITORING TV CHANNEL SELECTING STATUS

BACKGROUND OF THE INVENTION (1) Field of the Invention

The present invention relates to a TV channel selecting status monitoring method and apparatus and, more particularly, to a method and apparatus for determining a video/audio source and its broadcast channel to which the TV set is actually tuned.

(2) Description of the Prior Art

When a rating company monitors the channel tuning or selecting status of the TV set placed at each sample household for the purpose of audience measurement, a measuring apparatus called a TV sensor or audimeter is connected to the TV set so that the apparatus obtains TV set ON/OFF information and the number of the currently selected channel in association with time information and periodically sends them to a computer of the research center through a telephone circuit.

A source of video signals for display on the cathode-ray tube of the TV set and audio signals for output from its loudspeaker will hereinafter be referred to as a video/audio source, or simply as a source. A typical source is a VHF/UHF tuner built in the TV set. Other possible sources are a BS tuner, a CATV tuner, a CS (Communication Satellite) TV tuner, a VCR (Video Cassette Recorder), an electronic game machine, and so forth.

In the past when TV sets were usually used singly, it was necessary, for audience measurement, only to obtain the TV set ON/OFF information and the number of the channel actually selected by the VHF/UHF tuner in the TV set in association with time data. With the recent widespread use of a VCR and similar audio-visual (AV) apparatus and an AV/TV set (a TV set which has a plurality of video/audio input terminals and adapted to be used also as a monitor of an external apparatus such as a VCR), it has become necessary to detect the source actually selected by the TV set prior to the above-mentioned channel identification.

According to a conventional method (hereinafter referred to as a first conventional method) of searching for the actually selected source, audio signals to be applied from the VCR and similar sources to the TV set are each mixed with an identification signal of an inaudible frequency and are sequentially fed to individual video/audio input terminals, and a check is made to see if the identification signal is contained in each of audio signals obtained by picking up sounds from the loudspeaker of the TV set by a microphone. In this method, when the audio signal is decided as containing the identification signal, the video/audio input terminal corresponding thereto is specified as the video/audio input terminal currently selected for displaying video signals of the corresponding source on the TV set. Incidentally, when none of the video/audio input terminals are decided as being selected, it is determined that the broadcast waves are being received by the tuner in the TV set, if the TV set is ON and if the channel concerned can be specified.

On the other hand, there has been proposed a method (hereinafter referred to as a second conventional method) for detecting the channel on which video signals are actually displayed on the TV screen. This method detects a local oscillation signal of the tuner in the TV set to be monitored, and detects the currently receiving channel from the frequency of the oscillation signal through utilization of a one-to-one correspondence between them.

Another conventional method (hereinafter referred to as a third conventional method) is one that obtains an audio signal from the TV set and compares it with an audio signal of each channel played back by a reference receiver independently of the TV set, thereby identifying the currently selected by the TV set.

However, the first conventional method is applicable only to the TV set of the type that contains the VHF/UHF tuner alone, and is not applicable to TV sets of the type having incorporated therein one or more tuners as well as the VHF/UHF tuner, such as an AV/TV set containing a BS tuner and an AV/TV set containing a VCR built-in. The reason for this is, for example, that in the AV/TV set containing a BS tuner built-in, the BS broadcast wave bypasses video/audio input terminals and directly reaches the TV set. Accordingly, when no video/audio input terminals are selected, it is impossible to distinguish between the VHF/UHF and BS broadcasts although it is known that the actually selected source is either one of them. The same is true of the AV/TV set with a VCR built therein.

The second conventional method is applicable only to a TV set which receives analog broadcast waves alone, and is not suitable for application to a TV set which receives CS digital broadcast and like digital broadcasts as well. The CS digital broadcast digitizes video signals for data compression and transmits four to eight channels on a time-division multiplex basis through a single transponder. This makes it impossible to specify that one of the channels to which the tuner of the CS digital broadcast receiver is tuned, even if its channel selecting status is detected through utilization of the local oscillation frequency.

A third conventional method involves direct comparison of audio signals for the channel identification, and is applicable to such a digital broadcast as the CS digital broadcast as well as to the existing ground wave analog broadcast. With this method, however, it is often impossible to detect channels because there are cases where a silent period continues for a long time in TV programs.

A possible modification of the third conventional method is to use video signals in place of audio signals. That is, the video signal displayed on the TV screen is compared directly with the video signal on each of channels generated by reference receivers independently of the TV set; the channels selected by the reference receivers are changed until the both video signals coincide, and the channel for which the video signals coincide is specified as the channel currently selected. With this method, however, relatively much time is required for the comparison of video signals for each channel. Hence, the channel identification by the comparison of video signals for every channel inevitably consumes a large amount of time.

Moreover, the method by the direct comparison of video signals is based on the premise that the video signals for comparison can be generated in the monitoring apparatus independently of the TV set. Accordingly, in the CATV broadcast which uses video signals scrambled by suppression of sync signals—recently widespread in urban areas—the video signals for comparison cannot be generated, and hence the channel identification is impossible. In the CATV broadcast, a pay channel is scrambled and a descramble signal is sent to contracted TV sets to descramble the video signals. However, the CATV receiver mounted in the monitoring apparatus is not formally contracted and hence is not supplied with the descramble signal; therefore, the video signals for comparison cannot be generated in the monitoring apparatus.

SUMMARY OF THE INVENTION

It is therefore an object of the present invention to provide a TV channel selecting status monitoring method and apparatus which permits detection of which source is being selected in a TV set which contains a plurality of sources such as a BS tuner and a VHF/UHF tuner and is also adapted for use as a monitor of an external source such as a CATV tuner.

Another object of the present invention is to provide a TV channel selecting status monitoring method and apparatus which, after the identification of a video/audio source actually selected by the user, permit efficient detection of that one of channels of video/audio source which is actually selected by the user.

Another object of the present invention is to provide a TV channel selecting status monitoring method and apparatus which, when candidate channels cannot be narrowed down to one particular channel actually selected by the user through the comparison of sync signals, permit ultimate detection of the actually selected channel by the comparison of video signals.

Still another object of the present invention is to provide a TV channel selecting status monitoring method and apparatus which permit the detection of an actually selected channel of the CATV broadcast as well by direct comparison of video signals.

According to a first aspect of the present invention, there is provided a TV channel selecting status monitoring method: for a TV set which has a plurality of video/audio sources built-in and at least one video/audio input terminal for inputting video and audio signals from at least one external video/audio source, said TV set being capable of providing a display and an acoustic output of -video and audio signals supplied from a user's arbitrarily selected one of said video/audio sources, said method comprising the steps of: (a) detecting vertical and horizontal sync signals of a video signal applied to a cathode-ray tube of said TV set; (b) detecting video signals output from said plurality of video/audio sources built in said TV set; (c) detecting a video signal output from said video/audio source connected to said video/audio input terminal of said TV set; (d) sequentially selecting said video signals detected in said steps (b) and (c); (e) separating vertical and horizontal sync signals from each of said video signals sequentially selected in said step (d); (f) measuring the time difference between said vertical and horizontal sync signals detected in said step (a) and said vertical and horizontal sync signals selected in said step (e); and (g) correcting said time difference measured in said step (f) in accordance with a premeasured delay time inherent in each of said plurality of video/audio sources, and determining that that one of said video/audio sources for which said corrected time difference is minimum is the video/audio source currently selected by said user.

According to a second aspect of the present invention, there is provided a TV channel selecting status monitoring apparatus for a TV set which has a plurality of video/audio sources built-in and at least one video/audio input terminal for inputting video and audio signals from at least one external video/audio source, said TV set being capable of providing a display and an acoustic output of the video and audio signals supplied from a user's arbitrarily selected one of said video/audio sources, said method comprising: sync signal detecting means for detecting vertical and horizontal sync signals of a video signal applied to a cathode-ray tube of said TV set; internal video signal detecting means for detecting video signals output from said plurality of video/audio sources built in said TV set; external video signal detecting means for detecting a video signal output from said video/audio source connected to said video/audio input terminal of said TV set; an analog switch which is supplied with said video signals detected by said internal video signal detecting means and said video signal detected by said external video signal detecting means, and selectively outputs one of said video signals; first sync separating means for separating vertical and horizontal sync signals from said video signal output from said analog switch; time difference measuring means which is supplied with first and second vertical and horizontal sync signals, and measures the time differences between said first and second vertical sync signals and between said first and second horizontal sync signals; and control means which: inputs said vertical and horizontal sync signals detected by said sync signal detecting means, as said first vertical and horizontal sync signals, to said time difference measuring means; inputs said vertical and horizontal sync signals separated by said first sync separating means from said video signal of each of said video/audio sources selectively fed thereto from said analog switch, as said second vertical and horizontal sync signals, to said time difference measuring means; measures, by said time difference measuring means, the time differences between said vertical and horizontal sync signals detected by said sync signal detecting means and said vertical and horizontal sync signals of said each video/audio source; corrects said measured time differences in accordance with a premeasured delay time inherent in said each video/audio source; and determines that one of said video/audio sources for which said corrected time difference is minimum is the video/audio source currently selected by said user.

According to a third aspect of the present invention, the method of the first aspect further comprises the steps of: (h) controlling a plurality of reference receivers to sequentially generate video signals of channels receivable from that one of said video/audio sources, which was determined to be currently selected by said user in said step (g), said plurality of reference receivers being capable of generating video signals of each channel of each TV broadcast independently of said TV set; (i) separating vertical and horizontal sync signals from each of said video signals generated in said step (h); (j) measuring the time difference between vertical and horizontal sync signals of said video/audio sources determined to be currently selected by said user in said step (g) and said vertical and horizontal sync signals separated in said step (i); and (k) correcting said time difference measured in said step (j) in accordance with a premeasured delay time inherent in each of said plurality of video/audio sources, and determining that a channel for which said corrected time difference is smaller than a predetermined threshold value is a candidate for a channel currently selected by said user.

According to a fourth aspect of the present invention, the apparatus of the second aspect further comprises: a plurality of reference receivers for generating video signals of each channel of each TV broadcast independently of said TV set; second sync separating means for separating vertical and horizontal sync signals from each of said video signals generated by said reference receivers; and a selector for selectively outputting either said vertical and horizontal sync signals detected by said sync signal detecting means or said vertical and horizontal sync signals separated by said second sync separating means; wherein said control means: inputs a video signal of said that one of video/audio source determined as being currently selected by said user, to said first sync separating means via said analog switch; inputs vertical and horizontal sync signals separated by said first sync separating means, as said first vertical and horizontal sync signals, to said time difference measuring means; sequentially generates, by said reference receivers, video 'signals of respective channels receivable from that one of said video/audio sources determined as currently selected by said user, and applies said video signals to said second sync separating means one by one; inputs vertical and horizontal sync signals separated by said second sync separating means, as said second vertical and horizontal sync signals, to said time difference measuring means; measures, by said time difference measuring means, the time differences between vertical and horizontal sync signals output from that one of said video/audio sources determined as currently selected by said user and vertical and horizontal sync signals of each channel generated by said reference receivers; corrects said measured time differences in accordance with a premeasured delay time inherent in said each of said plurality of video/audio sources; and determines that a channel for which said corrected time difference is smaller than a predetermined threshold value is a candidate for a channel currently selected by said user.

According to a fifth aspect of the present invention, the method of the third aspect further comprises the steps of: (l) when a plurality of channels are determined as candidates for said user's currently selected channel in said step (k), controlling said plurality of reference receivers to sequentially generate video signals of the same channels as said candidate channels; and (m) comparing, at a plurality of sample points common thereto, a video signal generated from that one of said video/audio sources determined to be currently selected by said user in said step (g) and video signals sequentially generated in said step (l), and detecting said user's currently selected channel based on the degree of coincidence between said video signals.

According to a sixth aspect of the present invention, the apparatus of the fifth aspect further comprises: a first A-D converter/frame memory for digitizing and storing said video signal output from said analog switch; and a second A-D converter/frame memory for digitizing and storing said video signals output from said reference receivers; wherein when a plurality of channels are determined as candidates for said user's currently selected channel by the comparison of said sync signals, said control means: controls said plurality of reference receivers to sequentially generate video signals of the same channels as said candidate channels, and inputs said video signals to said second A-D converter/frame memory; stores in said first A-D converter/frame memory a video signal generated by that one of said video/audio sources determined as the source currently selected by said user; compares those video signals at a plurality of sample points common thereto; and detects said user's currently selected channel based on the degree of coincidence between said video signals.

According to a seventh aspect of the present invention, the method of the fifth aspect further comprises the step of: (n) when said video/audio source connected to said video/audio input terminal of said TV set is a CATV tuner for CATV broadcast reception use, quasi-descrambling that one of video signals from a CATV receiver provided as said reference receiver which is of a pay channel scrambled by the suppression of sync signal; wherein said quasi-descrambling step (n) comprises the steps of: (n-1) generating vertical and horizontal blanking intervals from said vertical and horizontal sync signals detected in said step (a); (n-2) extracting signals in said vertical and horizontal blanking intervals in said scrambled video signal; (n-3) restoring said extracted signals to their original form before said video signal was scrambled; and (n-4) replacing said signals in said vertical and horizontal blanking intervals in said scrambled video signal with said restored signals to form descrambled video signals.

According to an eighth aspect of the present invention, the apparatus of the sixth aspect further comprises: a CATV receiver as one of said reference receivers; and a suppressed sync signal quasi-regenerator which quasi-descrambles that one of video signals from said CATV receiver which is of a pay channel scrambled by the suppression of sync signal; wherein said suppressed sync signal quasi-regenerator comprises: interval generating means for generating vertical and horizontal blanking intervals from said vertical and horizontal sync signals detected by said sync signal detecting means; signal extracting means for extracting signals in said vertical and horizontal blanking intervals in said scrambled video signal generated by said CATV receiver; sync signal restoring means for restoring said extracted signals to their original form before said video signal was scrambled; and video signal generating means for replacing said signals in said vertical and horizontal blanking intervals in said scrambled video signal from said CATV receiver with said restored signals from said sync signal restoring means to form descrambled video signals.

According to the first and second aspect of the present invention, vertical and horizontal sync signals are separated from video signals which are output from all selectable or receivable video/audio sources, that is, a plurality of video/audio sources built in the TV set and a plurality of video/audio sources disposed outside the TV set, and the phase differences between the vertical and horizontal sync signals of each of the video-audio source and vertical and horizontal sync signals of video signals applied to the cathode-ray tube of the TV set are measured. For at least a short time, the phase of the sync signal in the video signal from each video/audio source remains unchanged, and the phases of the sync signals from different video/audio sources are very unlikely to coincide. Accordingly, the video/audio source whose vertical and horizontal sync signals are in phase with those of the video signals applied to the cathode-ray tube can be decided as a source actually selected by the user.

According to the third and fourth aspects of the present invention, the phases of vertical and horizontal sync signals in the video signal from the video/audio source decided as being actually selected by the user are compared with the phases of vertical and horizontal sync signals of all receivable channels of the video/audio source decided as the actually selected source, generated by reference receivers independently of the TV set. For at least a short time, the phase of the sync signal in the video signal of each receivable channel of the video/audio source decided as being selected remains unchanged, and the phases of the sync signals from different channels are very unlikely to coincide. Hence, the channel actually selected can be identified by the comparison of sync signals in most cases. That is, that one of channels generated by the reference receivers independently of the TV set in which the vertical and horizontal sync signals coincide in phase with those in the video signal output from the video/audio source decided as being actually selected by the user can be decided as the actually selected channel.

According to the fifth and sixth aspects of the present invention, if the search for the actually selected channel by the comparison of sync signals fails to narrow down to one particular channel, the video signal from the video/audio source decided to be actually selected by the user is compared directly with :the video signal of each of the reference receivers corresponding to the channels narrowed down as candidates for the actually selected channel. Unlike the audio signal the video signal does not cease for a long time and the video signals on different channels are very unlikely to coincide. Hence, that one of channels generated by the reference receivers independently of the TV set in which the video signals coincide with those in the video signal output from the video/audio source decided as being actually selected by the user can be decided as the actually selected channel.

According to the seventh and eighth aspects of the present invention, when a video signal of the same channel as that of a scrambled video signal by the reference receiver is applied to the cathode-ray tube is fed to the cathode-ray tube of the TV set, vertical and horizontal sync signals of the video signal applied to the cathode-ray tube are used to quasi-descramble the reference video signal. Thus, the search for the actually selected channel by the direct calculation of video signals can also be made in the CATV broadcast using video signals scrambled by the suppression of sync signal.

BRIEF DESCRIPTION OF THE DRAWINGS

Other object, features and advantages of the present invention will become more fully understood from the following detailed description taken in conjunction with the accompanying drawings, in which:

FIGS. 5A and 5B are diagrams showing, by way of example, the contents of a source environment table having set thereon information about sources built in the TV set and a source environment table having set thereon information about non-interlaced equipment connected to the TV set;

FIG. 6 is a diagram depicting, by way of example, the contents of a channel environment table;

FIG. 7 is a diagram showing, by way of example, the contents of a channel environment table corresponding to a CATV tuner;

FIG. 8 is a diagram showing, by way of example, the contents of a delay time table which is used to search for an actually selected source;

FIG. 9 is a diagram showing, by way of example, the contents of a delay time table which is used to search for an actually selected channel;

DETAILED DESCRIPTION OF THE PREFERRED EMBODIMENTS

Figure 1:
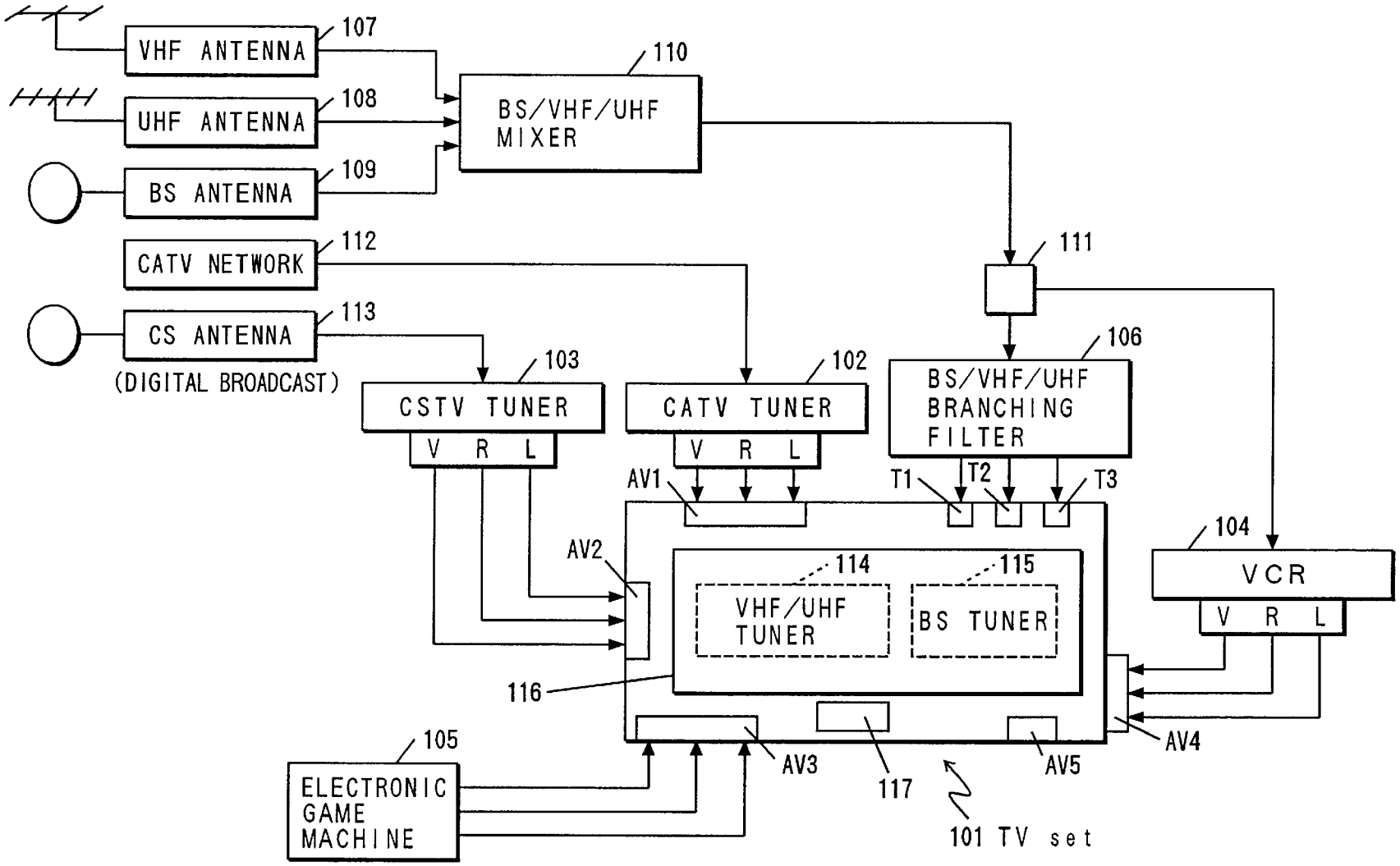
FIG. 1 is a block diagram illustrating an example of a system configuration which contains the TV set to be measured.

Referring first to FIG. 1, a TV set 101 placed at a sample household has a VHF/UHF tuner 114 and a BS tuner 115 built-in, and is provided with video/audio input terminals AV1 to AV4 for inputting there through video and audio signals from an external video/audio source, an audio/video output terminal AV5 for outputting there through a video signal and right and left audio signals from the BS tuner 115, and antenna input terminals T1 through T3. At the sample household there are further installed VHF, UHF and BS antennas 107, 108 and 109. VHF, UHF and BS broadcast waves received by the antennas 107, 108 and 109 are mixed by a mixer 110. The mixed output is provided via a branching filter ill to a BS/VHF/UHF branching filter 106, and branched into the VHF, VHF and BS broadcast waves, which are fed to the antenna input terminals T1, T2 and T3 corresponding thereto, respectively. As external sources, there are provided a CATV tuner 102, a CSTV tuner 103, a VCR 104 and an electronic game machine 105. Connected to the CATV tuner 102 is a CATV network 112, from which a CATV broadcast wave is input into the former. The CATV tuner 102 generates a video signal and right and left audio signals, which are fed to the video/audio input terminal AV1. The CSTV tuner 103 is supplied with CS (digital) broadcast wave received by a CS antenna 113. A video signal and right and left audio signals generated by the CSTV tuner 103 are fed to the video/audio input terminal AV2. The VCR 104, which in this example has a VHF/UHF tuner (not shown) built-in, is supplied with the broadcast waves branched by the branching filter 111, and records and plays back pictures on each channel of the VHF and UHF broadcasts. During recording and playback by the VCR 104 the video signals and right and left audio signals are provided to the video/audio input terminal AV4. Furthermore, video signals and right and left audio signals from the electronic game machine 105 are applied to the video/audio input terminal AV3.

With the use of an input source switching function of the TV set 101, a viewer at the sample household can freely select, for example, by remote control, a source of pictures for display on a cathode-ray tube 116 of the TV set 101 and sounds for play by a loudspeaker 117, from the VHF/UHF tuner 114, the BS tuner 115, the CATV tuner 102, the CSTV tuner 103, the VCR 104 and the electronic game machine 105. And, when the user has selected a source other than the electronic game machine 105, he can select by a channel switching operation a program on an arbitrary one of receivable broadcast channels of the selected source.

Figure 2A:
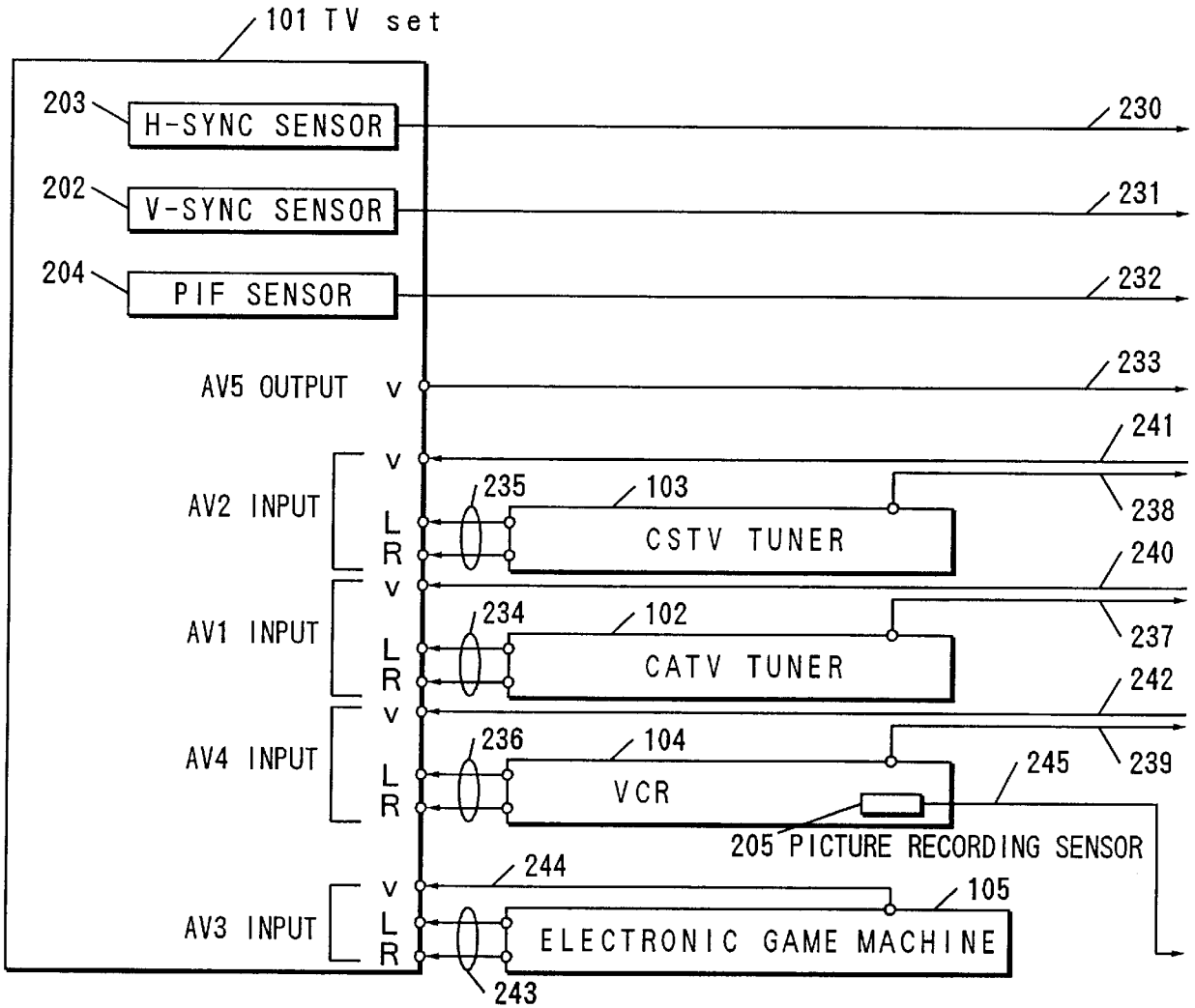
FIGS. 2A and 2B are block diagrams illustrating the system configuration containing the TV set and the system configuration of the monitoring apparatus, respectively, in a preferred embodiment of the present invention.
Figure 2B:
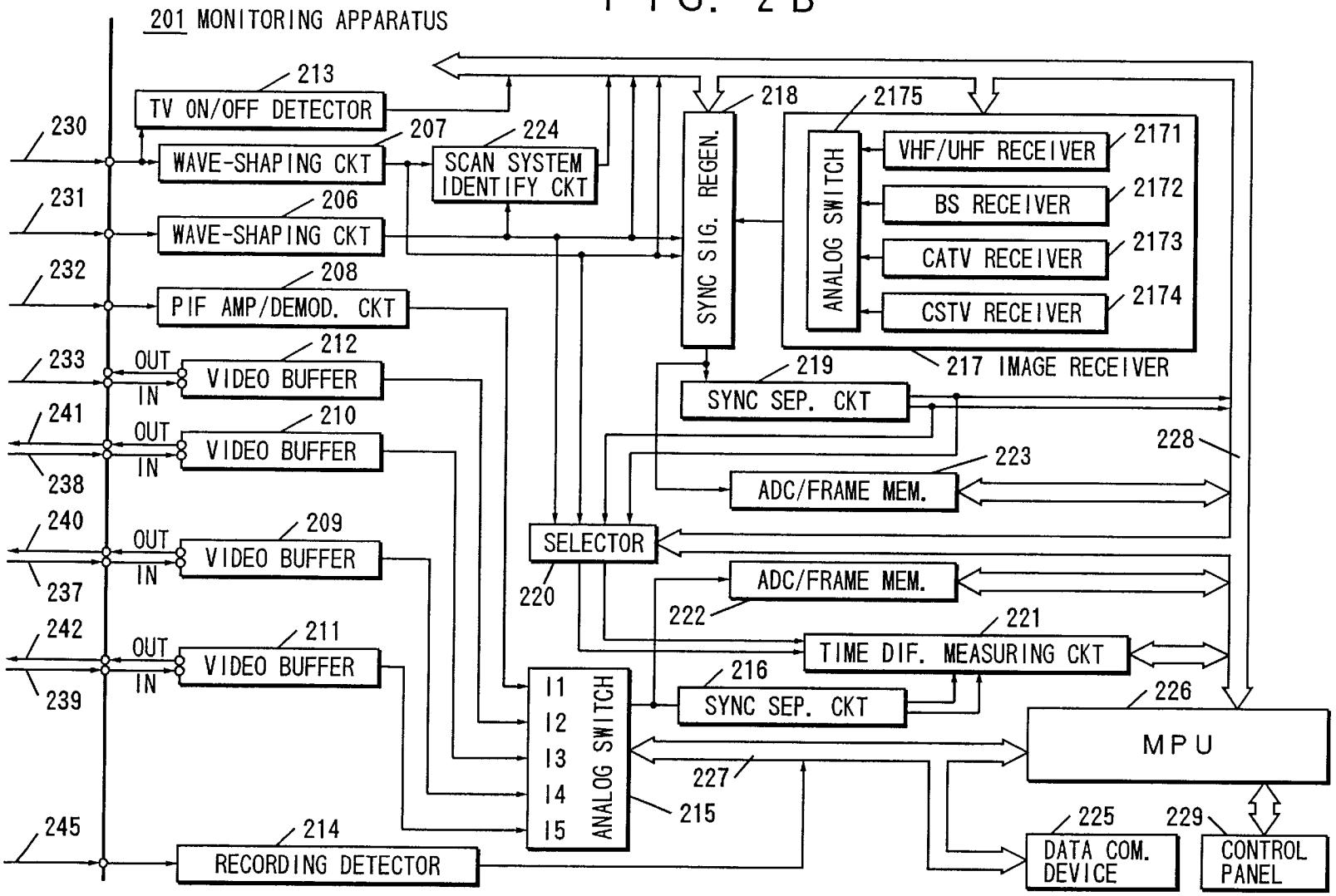

To search for the currently or actually selected and received source and channel in the TV set 101 that has such a variety of sources as depicted in FIG. 1, the monitoring apparatus according to the present invention, indicated generally by 201, is connected to the TV set 101 and the external sources 102 to 105 via cables 230 to 233, 237 to 239, 240 to 242 and 245 as shown in FIGS. 2A and 2B. In the TV set 101 there are further provided: a V-sync sensor (a magnetic pickup coil) 202, commonly called a vertical deflection sensor, disposed close to a deflection yoke of the cathode-ray tube for detecting a vertical sync signal; an H-sync sensor (a magnetic pickup coil) 203, commonly called a flyback sensor, disposed close to a flyback transformer or the like for detecting a horizontal sync signal; and a PIF (Picture Intermediate Frequency) sensor 204 disposed near the built-in VHF/UHF tuner 114 for detecting a picture or video: IF signal. The vertical and horizontal sync signals and video signals of display images on the cathode-ray tube 116 of the TV set 101, detected by the sensors 202, 203 and 204, are provided to the monitoring apparatus 201 through the cables 230, 231 and 232, respectively.

Video signals of the BS tuner 115 built in the TV set 101 are applied to the monitoring apparatus 201 from the video/audio output terminal AV5 via the cable 233.

The right and left audio signals of the CATV tuner 102, the CSTV tuner 103 and the VCR 103 are provided directly to the video/audio input terminals of the TV set 101 through the cables 234, 235 and 236, respectively, but video signals are fed to the video/audio terminals via the monitoring apparatus 201 through the cables 237 to 242. Audio and video signals of the electronic game machine 105 are applied directly to the video/audio input terminal of the TV set 101 through cables 243 and 244. The VCR 104 has a picture recording sensor 205 which is formed, for example, by a pickup coil, for the detection of an erase signal, and its output is applied to the monitoring apparatus 201 through the cable 245.

In the monitoring apparatus 201 there are provided at the input side from the TV set 101: one-shot multivibrators or similar wave-shaping circuits 206 and 207 which perform the waveform shaping of the detected signals from the V- and H-sync sensors 202 and 203 into pulses of fixed widths; a PIF amplifier/demodulator circuit 208 which amplifies the detected signal up to a predetermined level and then reconstructs the video signal; video buffers 209, 210, 211 and 212 which capture the video signals of the BS tuner 115, the CATV tuner 102, the CSTV tuner 103 and the VCR 104 via the cables 233, 237, 238 and 239, respectively; a TV ON/OFF detector 213 which detects the ON/OFF state of the TV set 101 based on the presence or absence of the output from the H-sync sensor 203; and a picture recording detector 214 which detects whether the VCR 104 is in its recording mode or not, based on the output from the picture recording sensor 205. The video buffers 209 to 212 are buffer amplifiers each of which amplifies the input video signal and branches it into two output signals. The video buffers 209, 210 and 211 are connected at one output end to the TV set 101 via the cables 240, 241 and 242 and at the other output end to an analog switch 215. The one output of the video buffer 212 is unused and the other output is connected to the analog switch 215. In the case where the BS tuner 115 is not built in the TV set 101 but placed outside it like the CSTV tuner 103, the video output from the external BS tuner is provided via the video buffer 212 to the TV set 101.

The monitoring apparatus 201 further comprises: the analog switch 215 which is supplied with video signals output from the video buffers 209, 210, 211 and 212 and selectively passes therethrough the video signals in a sequential order; a sync separation circuit 216 which generates vertical and horizontal sync signals synchronized with those contained in the video signal output from the analog switch 215; an A-D converter/frame memory 222 which converts the video signal output from the analog switch 215 to a digital signal and stores it. The sync separation circuit 216 contains a first oscillator (not shown) for generating the vertical sync signal and a second oscillator (not shown) for generating the horizontal sync signal. The first oscillator is normally in a free-running state, but when supplied with the video signal from the analog switch 215, it is phase-controlled to generate the vertical sync signal synchronized with that contained in the video signal. The second oscillator is also normally in the free-running state, but when supplied with the video signal from the analog switch 215, it is phase-controlled to generate the horizontal sync signal synchronized with that contained in the video signal.

In the monitoring apparatus 201 there are further provided: an image receiving circuit 217 for generating video signals of respective channels of the CATV, CS, BS, VHF and UHF broadcasts independently of the TV set 101; a suppressed sync signal quasi-regenerator 218 which receives the video signals from the image receiving circuit 217 and outputs video signals of scrambled channels of the CATV broadcast after quasi-descrambling the channels but outputs the other video signals (video signals of respective channels of the CS, BS, VHF and UHF broadcasts and video signals of unscrambled channels of the CATV broadcast) intact; a sync separation circuit 219 for extracting vertical and horizontal sync signals synchronized with those contained in each video signal output from the sync signal quasi-regenerator 218; and an A-D converter/frame memory 223 for converting the video signals output from the sync signal quasi-regenerator 218 into digital signals and storing them.

The receiving circuit 217 comprises: a VHF/UHF receiver 2171 which has a VHF/UHF tuner for receiving the VHF and UHF broadcasts and reconstructing video signals of their respective channels; a BS receiver 2172 which has a BS tuner for receiving the BS broadcast and reconstructing video signals of its respective channels; a CATV receiver 2173 which has a CATV tuner for receiving the CATV broadcast and reconstructing video signals of its respective channels; a CSTV receiver 2174 which has a CSTV tuner for receiving and reconstructing video signals of its respective channels; and an analog switch 2175 for selectively outputting the video signals fed thereto from the above receivers.

The monitoring apparatus 201 is further provided with: a selector 220 which selects either the vertical and horizontal sync signals from the wave-shaping circuits 206 and 207 or the vertical and horizonal sync signals from the sync separation circuit 219; and a time difference measuring part 221 which are supplied with the vertical and horizontal sync signals from both the selector 220 and the sync separation circuit 216, and measures differences in the time of arrival between the two vertical sync signals and between the two horizontal sync signals.

Furthermore, the monitoring apparatus 201 comprises: a scanning system identifying circuit 224 which identifies the scanning system of the video signal displayed on the cathode-ray tube 116 of the TV set 101, based on the vertical and horizontal sync signals from the wave-shaping circuits 206 and 207; and a data communication device 225 which sends monitored results over an ordinary telephone line or the like to a research center.

Provided further in the monitoring apparatus 201 are an MPU (a microprocessor) 226 for controlling the respective parts of the monitoring apparatus 201, and a control panel 229 connected to the MPU 226. The control panel 229 has a keyboard or the like (not shown) for entering commands and data for the MPU 226, and a display (not shown) for displaying data or the like output from the MPU 226.

The MPU 226, the picture recording detector 214, the analog switch 215 and the data communication device 225 are interconnected through a bus 227. The MPU 226, the TV ON/OFF detector 213, the scanning system identifying circuit 224, the wave-shaping circuits 206 and 207, the suppressed sync signal quasi-regenerator 218, the image receiving circuit 217, the sync separation circuit 219, the selector 220, the A-D converter/frame memories 222 and 223 and the time difference measuring part 221 are interconnected through a bus 228.

Figure 3:
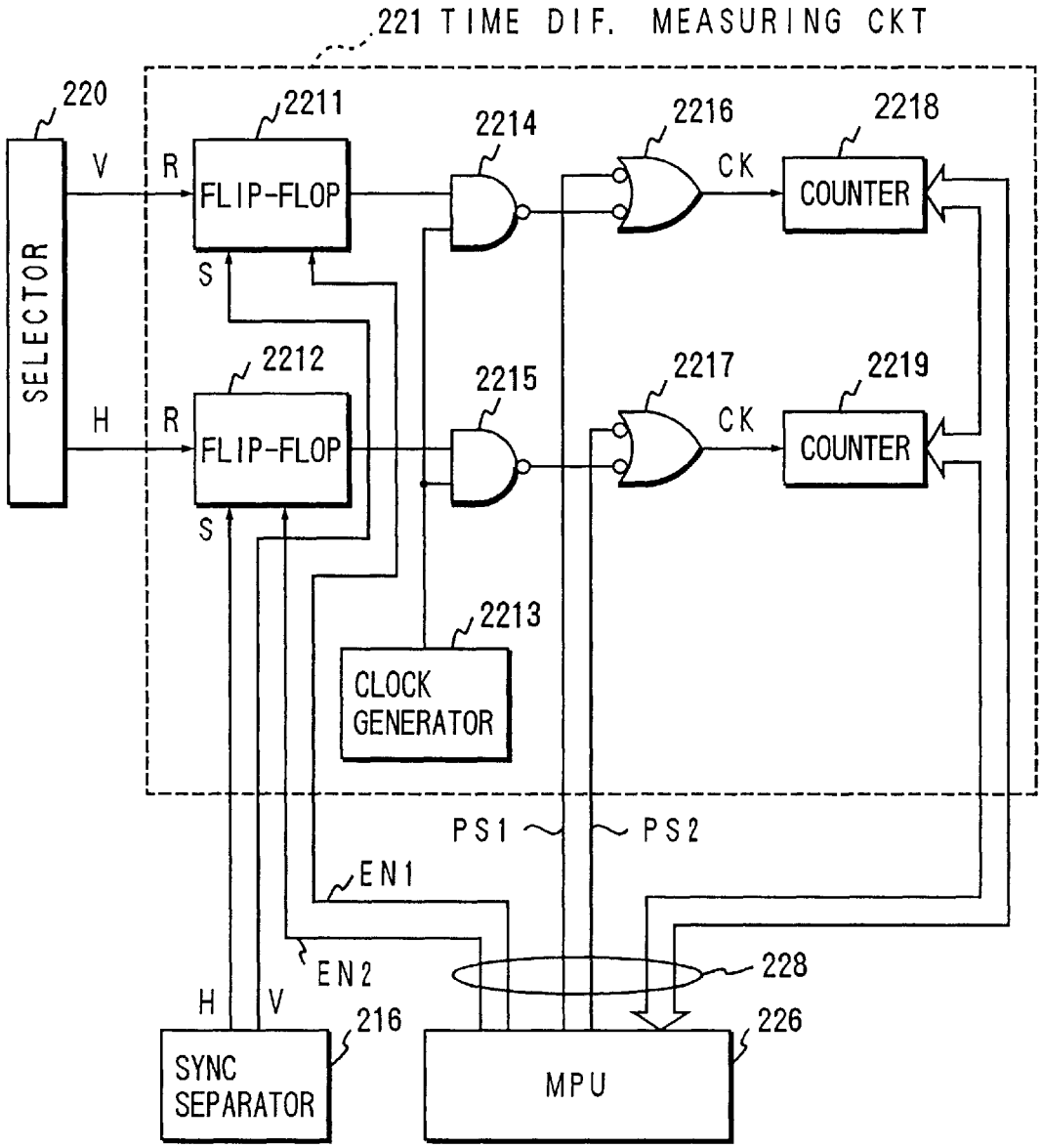
FIG. 3 is a block diagram depicting an example of the configuration of a time difference measuring part.

FIG. 3 illustrates in block form an example of the configuration of the time difference measuring part 221. The illustrated example of the time difference measuring part 221 comprises: flip-flops 2211 and 2212 which are respectively supplied with the vertical and horizontal sync signals from the selector 220 as reset signals, the vertical and horizontal sync signals from the sync separation circuit 216 as set signals, and enable signals EN1 and EN2 from the MPU 226 for determining the start of monitoring; a clock generator 2213 for generating a clock signal of a predetermined period; NAND gates 2214 and 2215 which are supplied with the clock signal from the clock generator 2213 and the output signals from the flip-flops 2211 and 2212, respectively; negative-logic input type OR gates 2216 and 2217 which are supplied with the outputs from the NAND gates 2214 and 2215 and preset signals PS1 and PS2 from the MPU 226, respectively; and preset type down counters 2218 and 2219 which are supplied with the outputs from the OR gates 2216 and 2217 as clock signals. Each of the counters 2218 and 2219 has a built-in register part (not shown) write-accessible from the MPU 226, and is a counter which has a function that presets a predetermined value in its internal counter part (not shown) by one clock signal fed thereto first after the writing of the predetermined value in the register part from the MPU 226 and counts down by the next clock signal.

Figure 4:
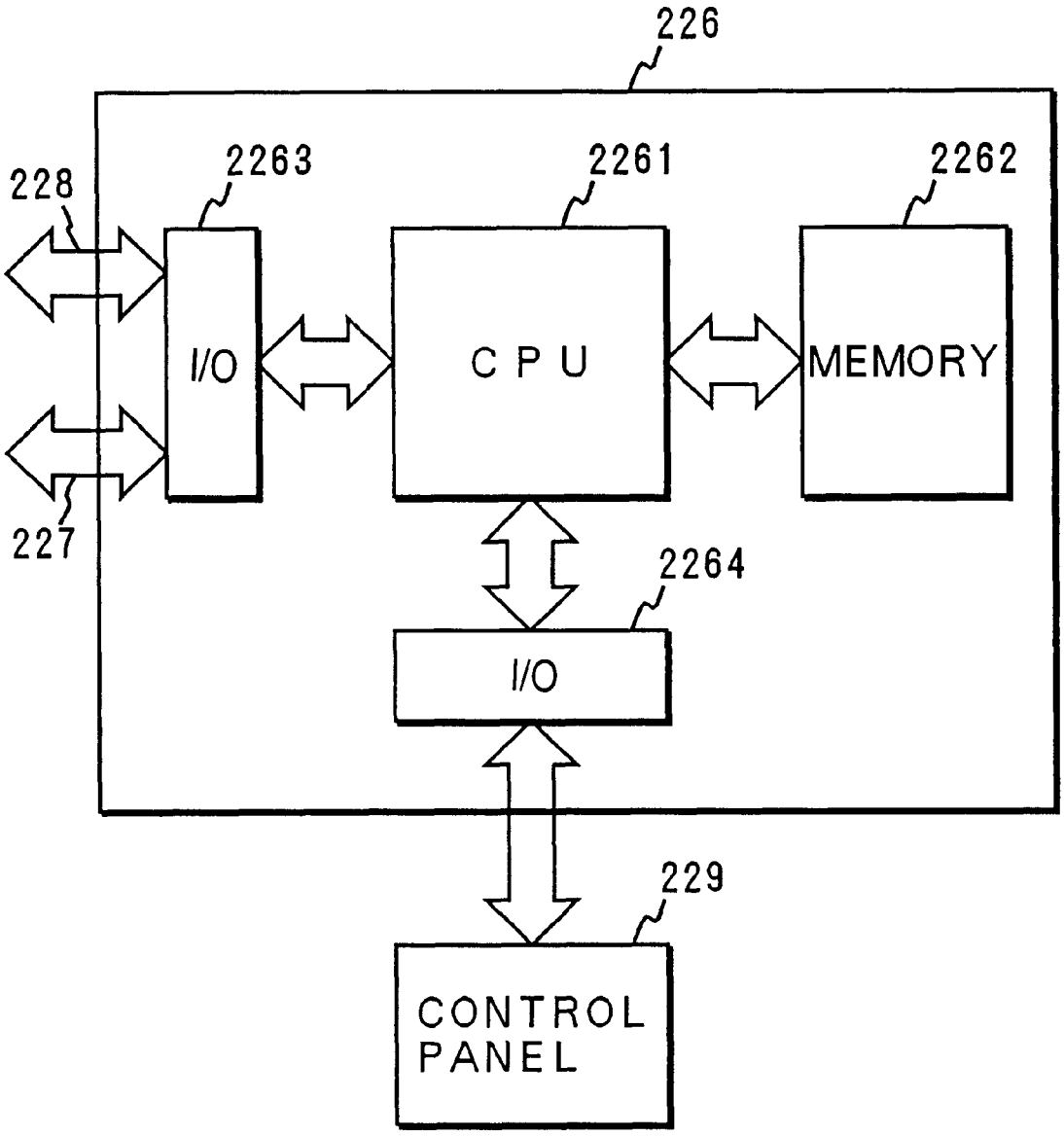
FIG. 4 a block diagram depicting an example of the internal configuration of an MPU.

FIG. 4 illustrates in block form an example of the internal configuration of the MPU 226. The illustrated example of the MPU 226 comprises a CPU 2261 and a memory 2262 and I/O interfaces 2263 and 2264 connected thereto. The I/O interface 2263 is provided between the CPU 2261 and the buses 227 and 228, and the I/O interface 226 is between the CPU 2261 and the control panel 229. The memory 2262 is formed by a RAM, EEPROM or the like, and stores a control program for the execution by the CPU 2261 and various data.

Next, a description will be given of an environment setting operation that takes place prior to the start of actual monitoring after the connection of the monitoring apparatus 201 to the TV set 101. The environment setting operation involves the generation of source environment tables, channel environment tables and two kinds of delay time tables.

(a) Generation of Source Environment Tables

TV sets to be monitored are as diverse in configuration as the TV set of FIG. 1 and those not connected to the CSTV tuner 103 or the VCR 104. The environment setting operation begins with checking what sources the TV set to be connected to the monitoring apparatus 201 have, followed by creating the source environment tables in the memory 2262 of the MPU 226. For example, in the case of the TV set 101 depicted in FIG. 1, the sources to be checked for the: currently selected channel are the TV set built-in VHF/UHF tuner 114, the TV set built-in BS tuner 115, the CSTV tuner 103, the CATV tuner 102 and the VCR 104. Video signals from these sources are fed to inputs I1 through I5 of the analog switch 215, respectively, as depicted in FIGS. 2A and 2B. Accordingly, such a source environment table 22621*a* as shown in FIG. 5A is generated. Furthermore, since the electronic game machine 105 that is non-interlaced scanning type equipment is provided as equipment which is not checked for the currently selected channel, a source environment table 22621*b* is also created which indicates the presence of the electronic game machine as non-interlaced scanning type equipment(FIG. 5B).

(b) Generation of Channel Environment Tables

Channels that can be received differ with areas where TV sets are placed. Hence, the next environment setting operation is to check, for each source, which broadcast channels can be received by the TV set, and to create channel environment tables accordingly. In this operation, information about receivable channels is entered from the control panel 229, and the channel environment tables are generated in the memory 2262 of the MPU 226. For example, in the case of the TV set 101 depicted in FIG. 1, a total of five channel environment tables are generated as shown in FIG. 6: a table 22622-1 that lists all channels receivable by the VHF/UHF tuner 114 built in the TV set 101, a table 22622-2 that lists all channels receivable by the BS tuner 115 built in the TV set 101, a table 22622-3 that lists all channels receivable by the CSTV tuner 103, a table 22622-4 that lists all channels receivable by the CATV tuner 102, and a table 22622-5 that lists all channels receivable by the VHF/UHF tuner built in the VCR 104. In the table 22622-4 corresponding to the CATV broadcast, there is also set a value indicative of whether each channel is scrambled or not as shown in FIG. 7. The channel C1 with a value 0 set in the column of scramble in FIG. 7 is a non-scrambled free-of-charge channel, whereas the channel C2 with a value 1 set in the column is a scrambled pay channel.

(c) Creation of Delay Time Table for Detecting Selected Source

The monitoring apparatus 201 of this embodiment detects or determines the currently selected source by making a comparison between the phases of the vertical and horizontal sync signals detected by the V- and H-sync sensors 202 and 203 (sync signals at the cathode-ray tube side) and the phases of the vertical and horizontal sync signals contained in the video signals input via the PIF amplifier/demodulator circuit 208 and the video buffers 210 to 211. This utilizes the principles that the phases of the sync signals from the same source remain unchanged at least for a short time but that the phases of the sync signals from different sources are very unlikely to coincide with each other. For example, when pictures of a certain channel selected by the VHF/UHF tuner 114 show up on the cathode-ray tube 116 of the TV set 101 depicted in FIG. 2A, the vertical and horizontal sync signals detected by the V- and H-sync sensors 202 and 203, respectively, are in phase with the vertical and horizontal sync signals contained in the video signal input via the PIF amplifier/demodulator circuit 208, but are out of phase with the vertical and horizontal sync signals contained in video signals from the CSTV tuner 103 and other sources.

In this embodiment the degree of coincidence between the phases of sync signals is measured in the time difference measuring part 221. The detected signal from the PIF sensor 203 is delayed by the PIF amplifier/demodulator circuit 208 for a relatively long time. The vertical and horizontal sync signals detected by the V- and H-sync sensors are also delayed by their built-in detectors; the former is delayed for a longer time than the latter. Substantially no delays develop in the sync signals that are detected from the video signals from external sources connected to the video/audio input terminals and the built-in BS tuner 115. In this situation, the time difference that is measured in the time difference measuring part 221 will not correctly reflect the amounts of phase shift between the vertical and horizontal sync signals in each source and the vertical and horizontal sync signals detected by the V- and H-sync sensors 202 and 203, respectively. To detect the sync signals under the same conditions and to minimize the above-mentioned time difference during the actual monitoring operation, the environment setting operation involves the measurement of the delay time for each source and storing the measured values in the memory 2262 of the MPU 226. The procedure for measuring the delay time for each source will be described below.

The procedure begins with selecting a certain source, for example, the built in VHF/UHF tuner 114 so that a program on its arbitrary channel is displayed on the cathode-ray tube 116 of the TV set 101. The next step is to enter a command via the control panel 229 to the MPU 226, causing the selector 220 to select the outputs from the wave-shaping circuits 206 and 207 and the analog switch 215 to select the output from the PIF amplifier/demodulator circuit 208. That is, the time difference measuring part 221 is supplied with the vertical and horizontal sync signals at the cathode-ray tube side and the vertical and horizontal sync signals generated by the sync separation circuit 216 and synchronized with the sync signals in the video signal from the VHF/UHF tuner 114. Then the time difference t between the sync signals of the two routes is measured in the time difference measuring part 221 under the same condition as that for the actual channel monitoring operation described later on. The measured value is displayed on the display of the control panel 229. Incidentally, since the time difference t is substantially the same for both of the vertical and horizontal sync signals, the time difference needs only to be measured for either one of them. In this way, the time difference t is measured for each source with the BS tuner 115, the CATV tuner 102, the CSTV tuner 103 and the VCR 104 switched one after another. The accuracy of measurement could be increased by measuring the time difference a plurality of times for each source and averaging the measured values. The measurement results and the source names are input into the MPU 226 via the control panel 229 to create in the memory 2262 such a delay time table 2263 as depicted in FIG. 8.

(d) Creation of Delay Time Table for Detecting Selected Channel

With the monitoring apparatus 201 of this embodiment, the currently selected source is specified first, and then checked for the currently selected channel by the phase comparison between vertical and horizontal sync signals in the video signal on each channel of the source specified as being currently selected and the vertical and horizontal sync signals on each channel generated by the image receiving circuit 217. If no particular channel can be specified as a candidate for the currently selected channel by the phase comparison, then the video signal of the selected source and the video signal on each channel generated by the image receiving circuit 217 are sampled at the same point in time (at the same point in the same field) based on the sync signals, and the sampled values are compared to thereby specify the currently selected channel. To perform this, it is necessary to premeasure the time differences between the sync signals of each source in the image receiving circuit 217 and the sync signals of each source provided at the side of the TV set 101. This measurement is made as described below.

The first step is to select an arbitrary channel by a certain input source, for example, VHF/UHF tuner 114. Next, a command is entered via the control panel 229 to the MPU 226, causing the VHF/UHF receiver 2171 of the image receiving circuit 217 to select the same channel as that of the input source and causing the analog switch 2175 to select the output from the sync signal extracting circuit 219. At the same time, the selector 220 is controlled to select the output from the sync separation circuit 219, and the analog switch 215 is controlled to select the output from the PIF amplifier/demodulator circuit 208. That is, the vertical and horizontal sync signals contained in the video signal on the channel by the VHF/UHF tuner 114 are provided to the time difference measuring part 22. At the same time, the video signal of the same source and the same channel of the image receiving circuit 217 as those selected by the VHF/UHF tuner 114 is provided to the sync separation circuit 219 via the suppressed sync signal quasi-regenerator 218. And, the vertical and horizontal sync signals extracted by the sync separation circuit 219 are fed to the time difference measuring part 221. Then the time difference t between the sync signals of two routes is measured in the time difference measuring part 221 under the same condition as that for the actual channel monitoring operation described later on. The measured value is displayed on the display of the control panel 229. Incidentally, since the time difference t is substantially the same for both of the vertical and horizontal sync signals, the time difference needs only to be measured for either one of them. In this way, the time difference t is measured for each input source with the BS tuner 115, the CATV tuner 102, the CSTV tuner 103 and the VCR 104 switched one by one in a sequential order; at the same time, the BS receiver 2172, the CATV receiver 2173 the CSTV receiver 2174 and the VHF/UHF receiver 2171 are similarly switched one after another in this order. The accuracy of measurement could be increased by measuring the time difference t a plurality of times for each source and averaging the measured values. The measurement results and the source names are input into the MPU 226 via the control panel 229 to create in the memory 2262 such a delay time table 2264 as depicted in FIG. 9.

Next, a description will be given of the operation of the monitoring apparatus 201 for detecting the currently selected source of the TV set 101.

In FIGS. 2A and 2B, when the TV set 101 is ON with a picture displayed on its screen, sync signal pulses are detected by the V- and H-sync sensors 202 and 203, and are each shaped by one of the wave-shaping circuits 206 and 207 into a sync signal of a predetermined pulse width. The sync signal pulse by the H-sync sensor 203 is also applied to the TV ON/OFF detecting circuit 213, which detects the ON state of the TV set 101 and indicates it to the MPU 226.

Based on the sync signals applied thereto from the wave-shaping circuits 206 and 207, the scanning system identifying circuit 224 determines whether the scanning system of the video signal on the TV screen is the interlaced or non-interlaced scanning system, and sends the decision result to the MPU 226.

When the TV set 101 is in the ON state, the MPU 226 searches for the currently selected source. In this instance, if the non-interlaced scanning system is detected in the scanning system identifying circuit 224, the MPU determines that the electronic game machine 105 is the source currently selected. The reason for this is that the scanning system for the video signal of the electronic game machine 105 is the non-interlaced scanning system different from the interlaced one adopted for ordinary TV broadcast waves. Letting repetitive frequencies of the horizontal and vertical sync signals of the video signal be represented by Fh and Fv, respectively, the ordinary TV broadcasts employ the interlaced scanning system in which the sync signals bear a relationship of Fh=262.5 Fv when Fh=15.734 kHz and Fv=59.94 Hz. In contrast thereto, the electronic game machine 105 adopts the non-interlaced scanning system in which the sync signals bear a relationship of Fh=262 Fv when Fh=15.7~15.8 kHz and Fv=59~61 Hz.

On the other hand, when the interlaced scanning system is detected in the scanning system identifying circuit 224, any one of the other sources than the electronic game machine 105 is the currently selected source. To continue the search for the source currently selected, the MPU 226 switches the selector 220 to permit the passage therethrough of the sync signals from the wave-shaping circuits 206 and 207 to the time difference measuring part 221.

The PIF sensor 204 detects the video IF signal output from the VHF/UHF tuner. The video IF signal is applied to the PIF amplifying/demodulating circuit 208, wherein it is amplified and then demodulated to the video signal. And, if the CATV tuner 102, the CSTV tuner 103, the VCR 104 and the BS tuner 115 output video signals, they are applied to the video buffers 209, 210, 211 and 212.

The analog switch 215 inputs: the video signal from the VHF/UHF tuner 114, demodulated by the PIF amplifier/demodulator circuit 208; the video signal from the BS tuner 115 provided via the video buffer 212; the video signal from the CSTV tuner 103 provided via the video buffer 210; the video signal from the CATV tuner 102 provided via the video buffer 209; and the video signal from the VCR 104 provided via the video buffer 211. Under the control of the MPU 226 the analog switch 215 selectively pass the input video signals in a predetermined order, for example, I1-I2-I3-I4-I5.

The sync separation circuit 216 extracts vertical and horizontal sync signals from the video signal fed thereto via the analog switch 215, and applies them to the time difference measuring part 221. Further, since the selector 220 is held connected to the wave-shaping circuits 206 and 207, the vertical and horizontal sync signals generated by them are provided via the selector 220 to the time difference measuring part 221.

Each time the analog switch 215 selects one input thereto, the MPU 226 writes a predetermined value into registers in the counters 2218 and 2219 of the time difference measuring part 221, and at the same time, applies single pulses (preset signals) via the gates 2216 and 2217 to the counters 2218 and 2219 to preset therein. the above predetermined value. Then, at predetermined timing the MPU 226 makes active (high-level) the enable signals to be fed to the flip-flops 2211 and 2212, and at subsequent predetermined timing, makes the enable signals inactive (low-level), and the MPU 226 inputs as data the count values of the counters 2218 and 2219 at the latter point in time. At this time, based on the sync signals which are applied thereto from the wave-shaping circuits 206 and 207 via the bus 228, the MPU 226 provides timing to control the measurement of time difference.

The outputs from the flip-flops 2211 and 2212 go low on the application thereto of the sync signal pulses from the wave-shaping circuits 206 and 207, and go high on the application thereto of the sync signal pulse from the sync separation circuit 216. Accordingly, the NAND gates 2214 and 2215 permit the passage therethrough of inverted versions of clock signals from the clock generator 2213 by the time interval t from the application of the pulse from the sync separation circuit 216 to the application of the pulses from the wave-shaping circuits 206 and 207. Since the output signals from the NAND gates 2214 and 2215 are applied via the gates 2216 and 2217 to the counters 2218 and 2219, their count values correspond to the above-mentioned time interval t.

Figure 10:
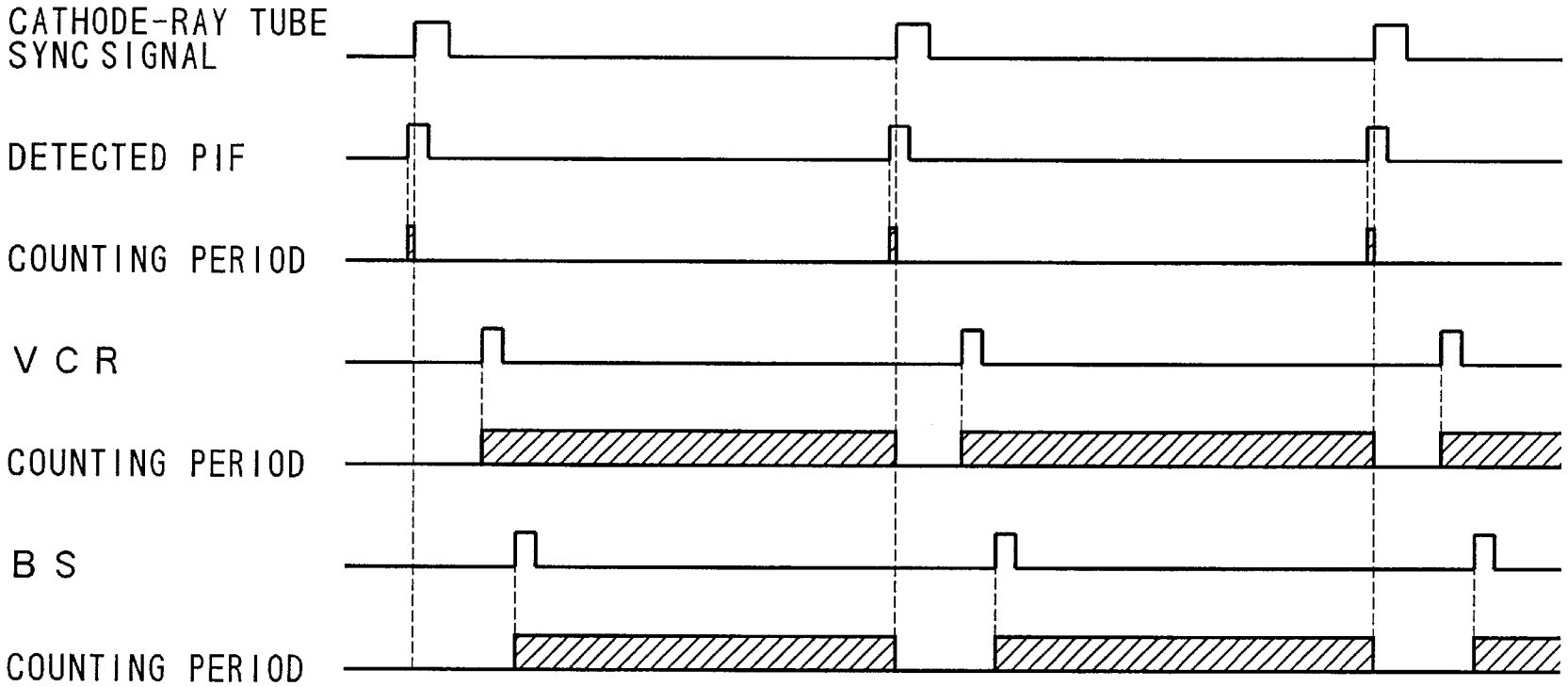
FIG. 10 is a timing chart depicting the operation of an embodiment.

In FIG. 10 there are shown, by way of example, the temporal relationships of the sync signal available from the TV set 101 (identified as "Cathode-ray tube sync signal"), the sync signal from the built-in VHF/UHF tuner 114 (identified as "Detected PIF"), the sync signal from the VCR 104 (denoted by "VCR") and the sync signal from the built-in BS tuner 115 (denoted by "BS"). Also shown in FIG. 10 are examples of the counting interval (indicated by hatching) when each source is selected by the analog switch 215. Incidentally, the vertical and horizontal sync signals greatly differ in duration, but their relationship remain substantially constant. The relationships of the sync signals depicted in FIG. 10 are also applicable to the sync signals available from the CATV tuner 102 and the CSTV tuner 103, though they are not shown.

As referred to previously, the phase of the sync signal from each source usually remains unchanged for at least a short time. The phases of the sync signals from different sources are very unlikely to coincide. Under the influence of the afore-mentioned delay time, however, the time difference that is measured in the time difference measuring part 221 does not accurately reflect the amounts of phase displacement between the vertical and horizontal sync signals from each source and the vertical and horizontal sync signals detected by the V- and H-sync sensors 202 and 203. As a solution to this problem, the MPU 226 corrects the count value for each source, based on the delay time corresponding thereto in the delay time table 22623 of FIG. 8, to minimize the time difference between the sync signals from the V- and H-sync sensors and the sync signals of the image displayed on the TV screen.

That is, a value t11-$\alpha$ is subtracted from the count value of the difference between the vertical and horizontal sync signals from the VHF/UHF tuner 114 and the vertical and horizontal sync signals detected by the V- and H-sync sensors 202 and 203. Similarly, t12-$\alpha$ is subtracted from the count value for the BS tuner; t14-$\alpha$ is subtracted from the count value for the CSTV tuner; t13-$\alpha$ is subtracted from the count value for the CSTV tuner; and t15-$\alpha$ is subtracted from the count value for the VCR built-in tuner. It is desirable to set $\alpha$ at a value such that $\alpha$ clear distinction could be made between adjacent channels of most closely spaced sync signals. For example, sync signals of general and educational TV channels of the NHK (Japan Broadcasting Corporation) are phased apart only one half the horizontal sync signal width (4.7 $\mu$S). In such an instance, $\alpha$ is set at a value, for example, about one half the phase difference, that is, at 1.2 $\mu$S. By making such corrections, the source for which the corrected count value is minimum can be decided as the source currently selected by the viewer.

As described above, in this embodiment the analog switch 215 is switched from one input source to another in a sequential order, and data is obtained from the time difference measuring part 221 for each source. The thus obtained data is corrected based on the delay time inherent in each source. Then the source for which the time differences between the vertical and horizontal sync signals detected by the V- and H-sync sensors 202 and 203 and the vertical and horizontal sync signals extracted by the sync separation circuit 216 take preferable minimum values is decided as the currently selected source based on the data corrected as mentioned above. The measurement of the time differences for both of the vertical and horizontal sync signals is intended to increase the accuracy of decision.

In the manner described above, when the interlaced scanning system is detected in the scanning system identifying circuit 224, the monitoring apparatus 201 specifies which of the VHF/UHF tuner 114, the BS tuner 115, the CATV tuner 102, the CSTV tuner 103 and the VCR 104 is the currently selected source.

Figure 11:
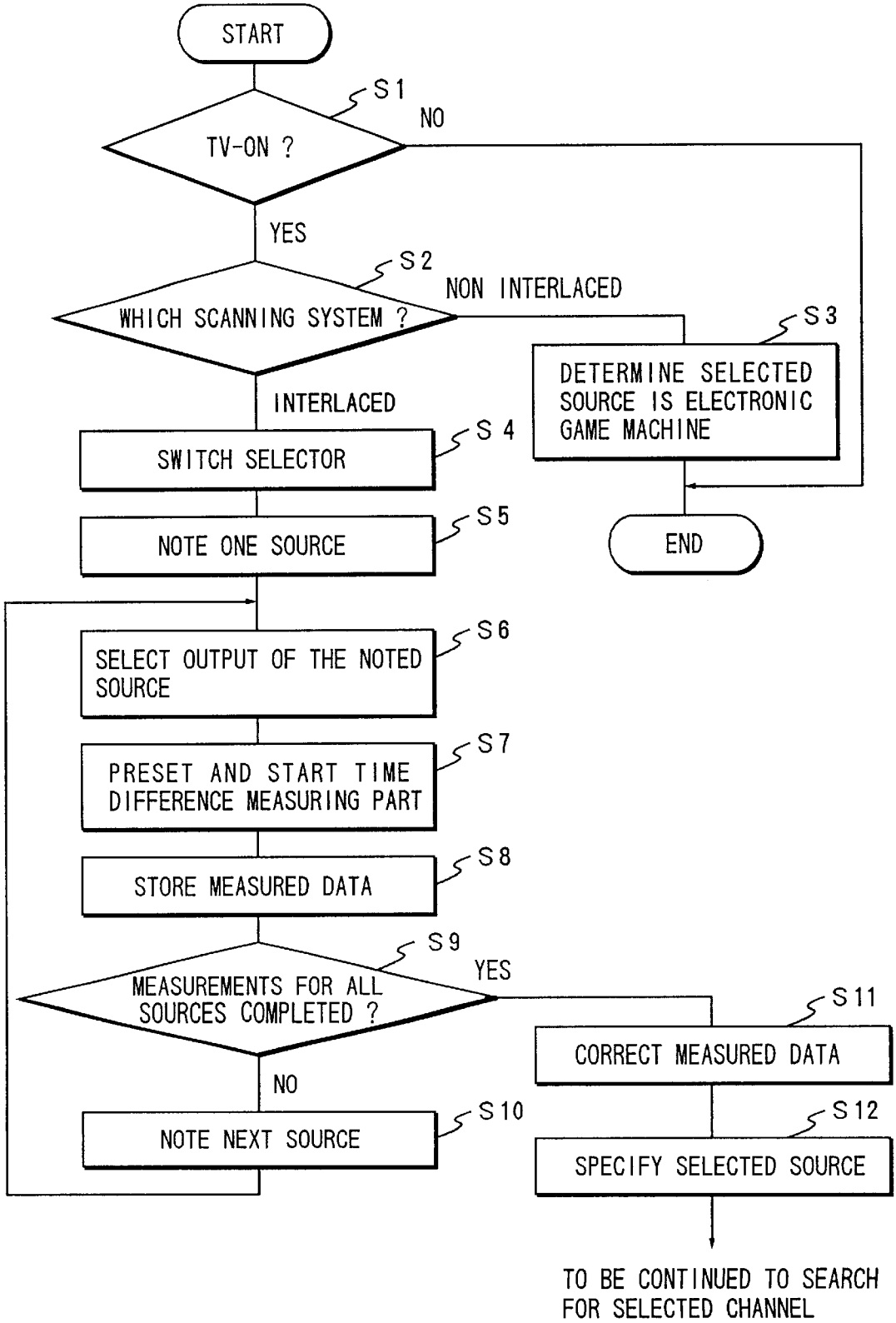
FIG. 11 is a flowchart showing an example of the procedure for deciding an actually selected source.

Next, a description will be given, with reference to FIG. 11, of an example of the processing by the MPU 226 for identifying the currently selected source.

The MPU 226 begins the currently selected source search procedure at fixed time intervals of one minute, for instance, through the use of a timer built in the CPU 2261. The first step is to make a check to see if the TV set 101 is ON, based on the output from the TV ON/OFF detector 213 (S1). If the TV set 101 is in the OFF state, then the current source search session is discontinued. If the TV set 101 is ON, the output from the scanning system identifying circuit 224 is used to determine if the scanning system of the video signal currently applied to the cathode-ray tube 116 of the TV set 101 is the interlaced or non-interlaced scanning system (S2). In the: latter case, reference is made to the source environment table 2261*b* of FIG. 5B stored in the memory 226, and the electronic game machine 105 is decided to be currently selected source (S3) accordingly, allowing the processing to be discontinued.

In the case of the interlaced scanning system, the processing is continued. In the first place, the outputs from the wave-shaping circuits 206 and 207 are selected by the selector 220 (S4). Then the VHF/UHF tuner 114 built in the TV set 101 is chosen which is one of the sources set in the source environment table 22621*a* of FIG. 5A (S5), and the analog switch 215 is caused to select the input I1 corresponding to the chosen source (S6). And the time. difference measuring part 221 is preset and started in such a manner as described previously (S7), and the measured data obtained with the time difference measuring part 221 is input into the memory 2262 and stored in its workarea (S8). Next, the BS tuner 115 contained in the TV set 101 is chosen which is the source set next to the. VHF/UHF tuner 114 in the source environment table 222621*a* (S10), followed by repeating steps S6 through S8. Upon completion of the measurements for all the sources set in the source environment table 22621*a* (YES in step S9), reference is made to the delay time table 22623 of FIG. 8 stored in the memory 2262 to make the afore-mentioned correction to the measured data stored in the workarea in correspondence to each source (FIG. 11). Then, based on the corrected measured data, the currently selected source is specified (S12). Following this, the MPU 226 proceeds to the procedure for determining which channel is being selected in the specified source.

Now, a description will be given of how the monitoring apparatus 201 searches for the channel currently selected and viewed on the TV set 101.

When the currently selected source is specified as described above, the monitoring apparatus 201 narrows down candidates for the currently selected channel by comparing the phases of the vertical and horizontal sync signals in the video signal of the source specified as the currently selected source and the phases of the vertical and horizontal sync signals of each channel generated by the image receiver 217 of the monitoring apparatus 201. If the candidates cannot be narrowed down to one channel by the phase comparison of the sync signals, the monitoring apparatus 201 makes a direct comparison between the video signal of the selected source and the video signal of each channel created by the image receiver 217, thereby specifying the currently selected and viewed channel.

(a) Determination of Selected Channel by Comparison of Sync Signals

Figure 12:
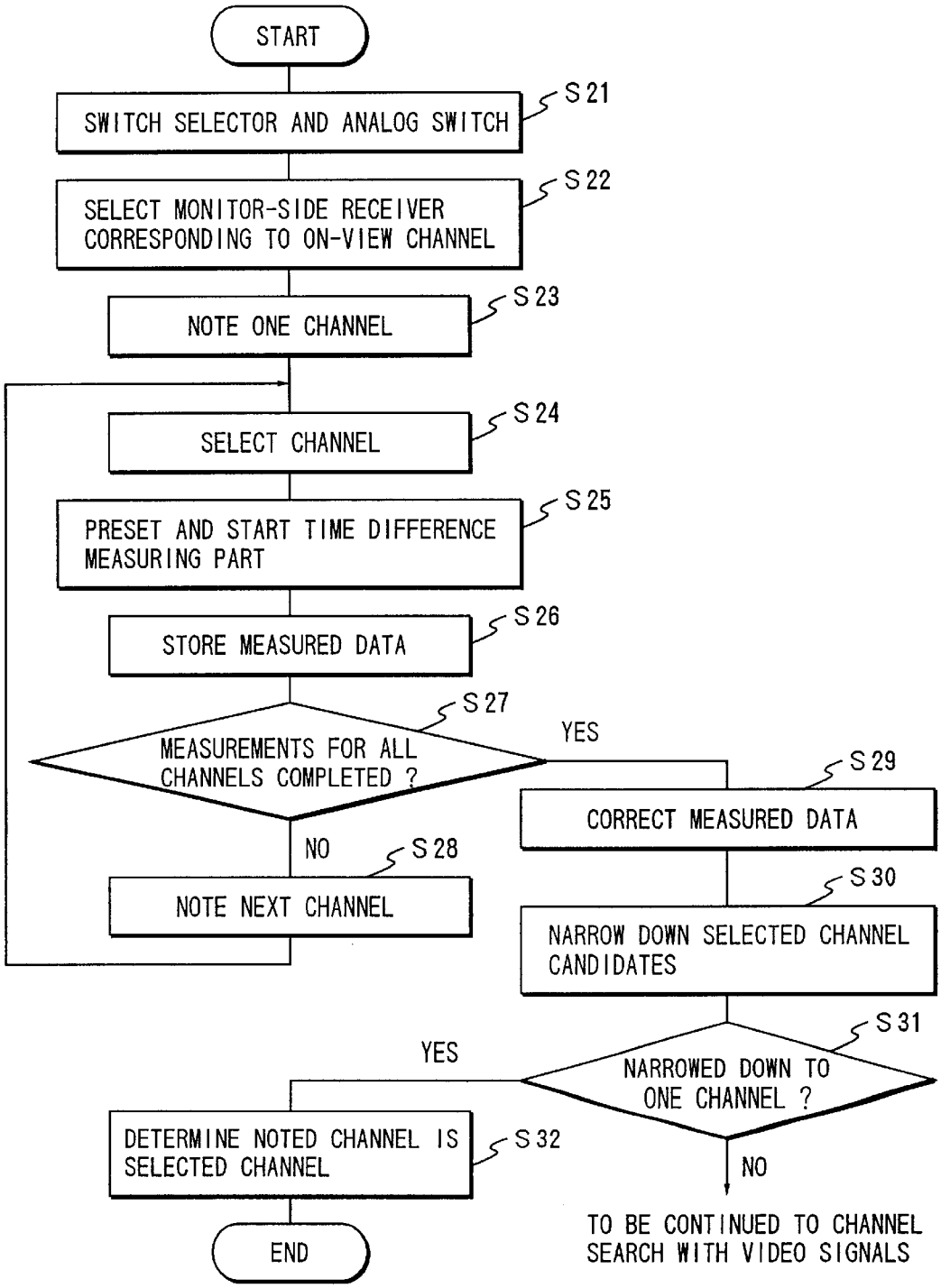
FIG. 12 is a flowchart showing an example of the procedure for deciding an actually selected channel by the comparison of sync signals.

First, the MPU 226 selects the output from the sync separation circuit 219 by the selector 220, and selects by the analog switch 215 the video signal of the source decided to be currently selected source by the above-described source determination procedure (S21 in FIG. 12). For example, when the VHF/UHF tuner 114 built in the TV set 101 is the currently selected source, the input terminal I1 of the analog switch 215 for the video signal from the PIF amplifier/demodulator circuit 208 is selected. When the CATV tuner is decided as the currently selected source, the input I4 of the analog switch 215 is selected. The video signal from the currently selected source, selected by the analog switch 215, is fed to the sync separation circuit 216, wherein vertical and horizontal sync signals are extracted from the video signal, and the sync signals are provided to the time difference measuring part 221.

Next, the MPU 226 controls the image receiver 217 of the monitoring apparatus 201 to decide, as a reference receiver, that one of the receivers which corresponds to the source decided as the currently selected source by the currently selected source determination procedure, and the MPU 226 selects the output from the reference receiver by the analog switch 2175 (S22). For example, when the VHF/UHF tuner 114 is the currently selected source, the VHF/UHF receiver 2171 is chosen as the reference receiver. When the CATV tuner 102 is the currently selected source, the CATV receiver 2174 becomes the reference receiver. And the MPU 226 chooses one channel described in that one of the channel environment tables stored in the memory 2262 which corresponds to the currently selected source (S23). For example, when the currently selected source is the VHF/UHF tuner 114 built in the TV set 101, the MPU 226 chooses one of the channels described in the channel environment table 22622-1 depicted in FIG. 6. In the case of the CATV tuner 102, one of the channels described in the channel environment table 2622-4 is chosen. Then the MPU 266 tunes the channel of the reference receiver to the chosen channel (S24). At this time, if the reference receiver is the CATV receiver 2173 and its chosen channel is scrambled, the MPU 226 makes a predetermined control signal for the suppressed sync signal quasi-regenerator circuit 218 a "1." When supplied with the "1" control signal, the sync signal quasi-regenerator circuit 218 quasi-descrambles the video signal fed thereto from the analog switch 2175. When the control signal is a "0," the circuit 218 outputs the input video signal intact. The sync separation circuit 219 extracts vertical and horizontal sync signals from the video signal applied thereto from the suppressed sync signal quasi-regenerator circuit 218, and provides the sync signals via the selector 220 to the time difference measuring part 221. The time difference measuring part 221 is also supplied with the vertical and horizontal sync signals contained in the video signal of the currently selected source provided from the analog switch 215.

Thereafter, the MPU 226 presets and starts the time difference measuring part 221 as in the currently selected source decision procedure (S25). That is, the MPU 226 writes a predetermined value in the registers of the counters 2218 and 2219 of the time difference measuring part 221, and inputs one pulse (a preset signal) via the gates 2216 and 2217 to the counters 2218 and 2219 to preset therein the above-mentioned predetermined value. Following this, the MPU 226 makes the enable signals for the flip-flops 2211 and 2212 active (high-level) at predetermined timing and inactive (low-level) at the subsequent predetermined timing, and reads thereinto the count values of the counters 2218 and 2219 at that point in time. In this case, the MPU 226 provides timing for the time difference measurement, based on the vertical and horizontal sync signals sent thereto from the sync separation circuit 219 over the bus 228.

The outputs from the flip-flops 2211 and 2212 go low on the application thereto of the sync signal pulse from the sync separation circuit 216, and go high on the application thereto of the sync signal pulse from the sync separation circuit 216. Accordingly, the NAND gates 2214 and 2215 permit the passage therethrough of inverted versions of clock signals from the clock generator 2213 by the time interval t from the application of the pulse from the sync separation circuit 219 to the application of the pulse from the sync separation circuit 216. Since the output signals from the NAND gates 2214 and 2215 are applied via the gates 2216 and 2217 to the counters 2218 and 2219, their count values correspond to the above-mentioned time interval t.

Next, the MPU 226 inputs the measured data from the time difference measuring part 221, and stores it in the workarea of the memory 2262 (S26). After this, the MPU 226 chooses the next channel described in the channel environment table corresponding to the currently selected source (S28), and repeats the processing of steps S24 to S26. Upon completion of the measurements for all the channels set in the channel environment table corresponding to the currently selected source (YES in S27), the MPU 226 make's reference to the delay time table 22624 of FIG. 9 stored in the memory 2262 to make the required correction to the measured data corresponding to each source stored in the workarea in the same manner as in the currently selected source decision processing (S29). That is, when the currently selected source is the VHF/Uhf tuner 114, t21-α is subtracted from the time difference value obtained between the currently selected source and the VHF/UHF receiver 2171. Similarly, when the currently selected source is the BS tuner 115, t22-α is subtracted from the time difference value between the currently selected source and the BS receiver 2172; in the case of the CATV tuner 103 being the currently selected source, t24-α is subtracted from the time difference value between it and the CATV receiver 2173; in the case of the CSTV tuner 103, t23-α is subtracted from the time difference value between it and the CSTV receiver 2174; and in the case of the VCR 104, t25-α is subtracted from the time difference value between it and the VHF/UHF receiver 2171. And, based on the thus corrected measured data, the MPU 226 narrows down the channels (S30).

In step S30, a threshold value is set to narrow down the channels; that is the channels are decided as candidates for the currently selected channel or not, depending on whether the time differences measured therefor are smaller or greater than the preset threshold value. The threshold value is set close to the afore-mentioned value α. The MPU 226 makes a check to see if the channels have been narrowed down to one channel (S31), and if so, the MPU 226 decides the channel as the currently selected and viewed channel (S32). The currently selected channel search processing ends up with this step. On the other hand, when the channels cannot be narrowed down to one channel in step S30, the MPU 226 advances to the channel decision procedure that involves a direct comparison of video signals.

(b) Determination of Selected Channel by Comparison of Video Signals

Figure 13:
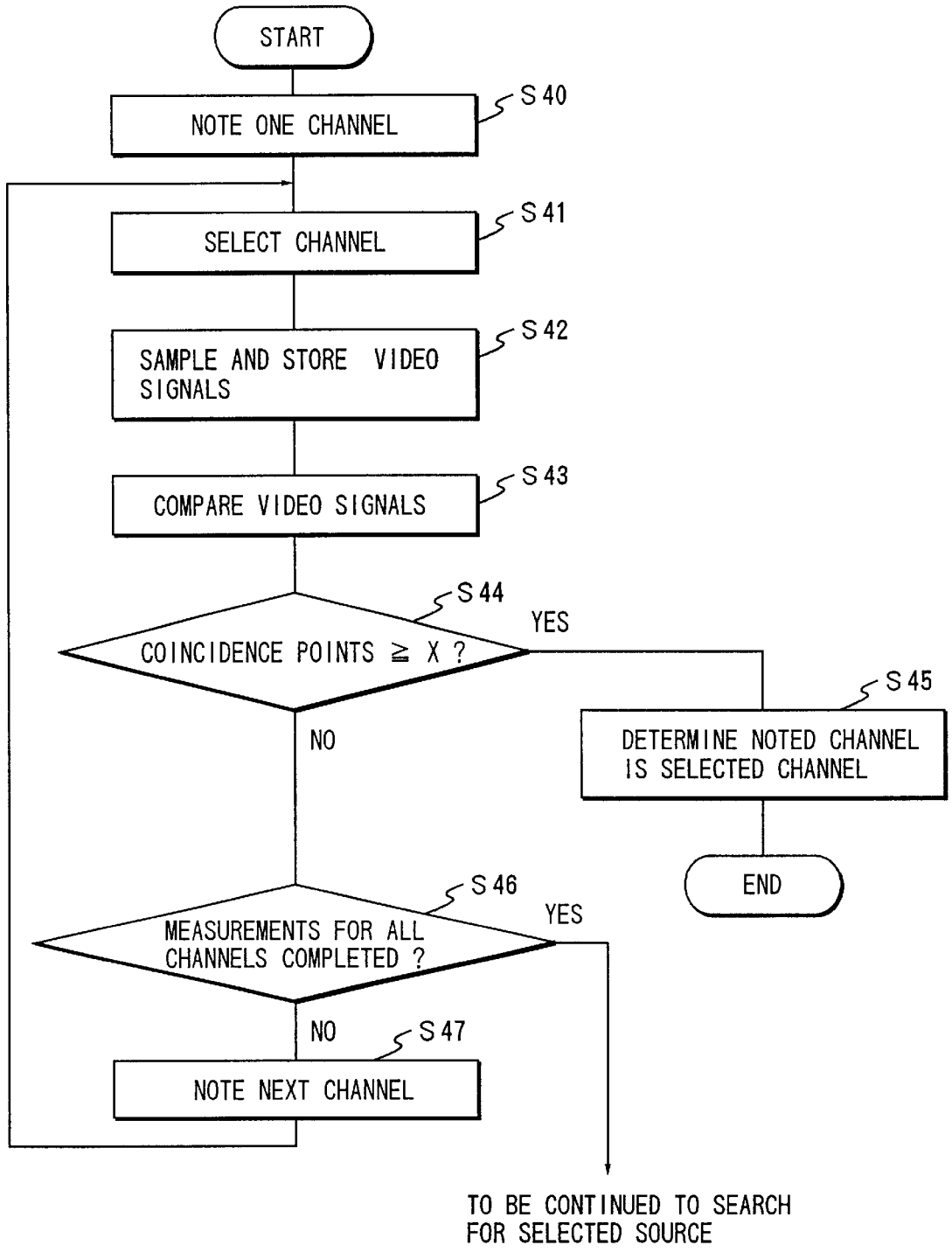
FIG. 13 is a flowchart showing an example of the procedure for deciding an actually selected channel by the comparison of video signals.

The MPU 226 chooses one of the plurality of channels narrowed down by the comparison of sync signals (S41 in FIG. 13), and tunes the channel of the reference receiver to the chosen channel (S42). When the reference receiver is the CATV receiver 2173 and the channel concerned is a scrambled one, the MPU 226 makes a predetermined control signal for the suppressed sync signal quasi-regenerator 218 a "1." When supplied with the "1" control signal, the sync signal quasi-regenerator circuit 218 quasi-descrambles the video signal fed thereto from the analog switch 2175. When the control signal is a "0," the circuit 218 outputs the input video signal intact. The video signal output from the circuit 218 is applied to the sync separation circuit 219 and the A-D converter/frame memory 223. The sync separation circuit 219 extracts vertical and horizontal sync signals from the video signal applied thereto from the circuit 218, and provides the sync signals to the MPU 226 and the selector 220 through the bus 228 (the sync signals fed to the selector 220 being not used in this case).

In the analog switch 215 the video signal of the currently selected source is selected and applied to the A-D converter/frame memory 222.

Thereafter, based on the vertical and horizontal sync signals applied thereto from the sync separation circuit 219 via the bus 228, the MPU 226 controls the A-D converter/frame memory 223 to digitize and store the reference video signal from the suppressed sync signal quasi-regenerator 218 and the A-D converter/frame memory 223 to digitize and store the video signal of the currently selected source output from the analog switch 215 at sample timing that is set taking into account the delay time corresponding to the currently selected source which falls inside the delay time of each source shown in FIG. 9 (S42). The number of sample points is set, for example, at 32 per one-field-one-frame video signal. The MPU 226 reads out the digital video signals from the A-D converter/frame memories 223 and 222, then compares the video signals at the same sample points, and counts the number of sample points at which the video signals coincide with each other (S43). When the number of sample points of coincidence between the video signals is greater than a predetermined value X (Yes in S44), the MPU 226 decides that the currently chosen channel is the selected and viewed channel (S45), allowing the current processing to be terminated. On the other hand, when the number of sample points of coincidence between the video signals is smaller than the predetermined value X (NO in S44), the MPU 226 chooses one of the remaining channels narrowed down by the comparison of the sync signals (S47), and repeats steps S41 through S44. In case no channel satisfies the condition that the number of sample points of coincidence, the MPU 226 performs the entire processing once again, starting with the selected channel determination procedure.

In the above, when the number of sample points of coincidence between the video signals is found to be greater than the threshold value X, the channel concerned is decided as the currently selected channel. It is also possible, however, to count the numbers of sample points of coincidence for all channels narrowed down by the comparison of sync signals and determine that the channel corresponding to the maximum one of the count values is the currently selected channel.

The MPU 226 thus determines the currently selected channel, and stores it and the current time as a piece of measured data in a measured data storage area of the memory 2262. When the currently selected source is the VCR 104, the MPU 226 uses the picture recording detector 214 to determine if the VCR 104 is in a picture recording mode, and stores the detection result as well. At a certain elapsed time the MPU 226 uses the data communication device 225 to call up the research center through an ordinary telephone line and send the sequence of stored measured data to the research center.

As described above, according to the monitoring apparatus of this embodiment, since the currently selected source is detected through utilization of the time difference between the sync signals of the cathode-ray tube 116 easily obtainable from the TV set 101 and the video signal of each source, it is possible to uniquely identify the currently selected source even in the case of a source whose video signal does not fed to the video/audio input terminal, such as an AV/TV set having a built-in BS tuner.

Furthermore, the search for the currently selected channel is made first by the comparison of sync signals, and when the channels cannot be narrowed down to one, the monitoring apparatus of this embodiment continues with the search by the comparison of video signals to specify the currently selected channel; hence, this apparatus is higher in efficiency than the prior art which makes the comparison of video signals from the beginning. Of course, when the monitoring apparatus of this embodiment fails to narrow channels down to a particular one, it makes the search by comparing video signals—this ensures that the currently selected channel can be identified with extremely high accuracy. Moreover, the monitoring apparatus of this embodiment permits detection of the currently selected channel by the comparison of video signals even in the presence of two or more channels use the same signal source and have in-phase sync signals.

Next, an embodiment of the suppressed sync signal quasi-regenerator 218 will be described.

Figure 14A:
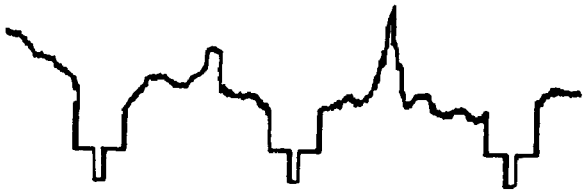
FIGS. 14A and 14B are waveform diagrams illustrating examples of a video signal before scrambled by the suppression of sync signal and a video signal after scrambled, respectively.
Figure 14B:
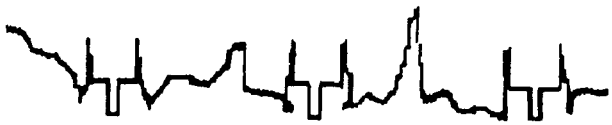

A description will be given first, with reference to FIGS. 14A and 14B, of scramble by the suppression of sync signal which is performed in the CATV broadcast. FIG. 14A shows a video signal prior to its scrambling, and FIG. 14B the scrambled version of the video signal. As will be seen from FIG. 14, the level of a blanking signal superimposed on the video signal is shifted toward the white level, and in some system the height of the sync pulse superimposed on the blanking period is also changed, thereby making the detection of the sync signal. In the CATV tuner 102 of a customer under formal contract for the reception of a pay-TV, the scrambled signal of FIG. 14B can be descrambled to the original signal of FIG. 14A by using a descrambling signal sent from the TV station separately of TV signals. However, no descrambling signal is sent to the CATV tuner in the CATV receiver 2173 of the image receiver 217 in the monitoring apparatus 201 because it is not under formal contract. Accordingly, the monitoring apparatus 201 cannot generates the video signals for comparison use without any particular means therefor. The suppressed sync signal quasi-regenerator 218 is a means which, on the CATV channel currently viewed on the TV set 101, the scrambled signal of FIG. 14B is converted to the descrambled signal of FIG. 14A without using the descrambling signal from the CATV station.

Figure 15:
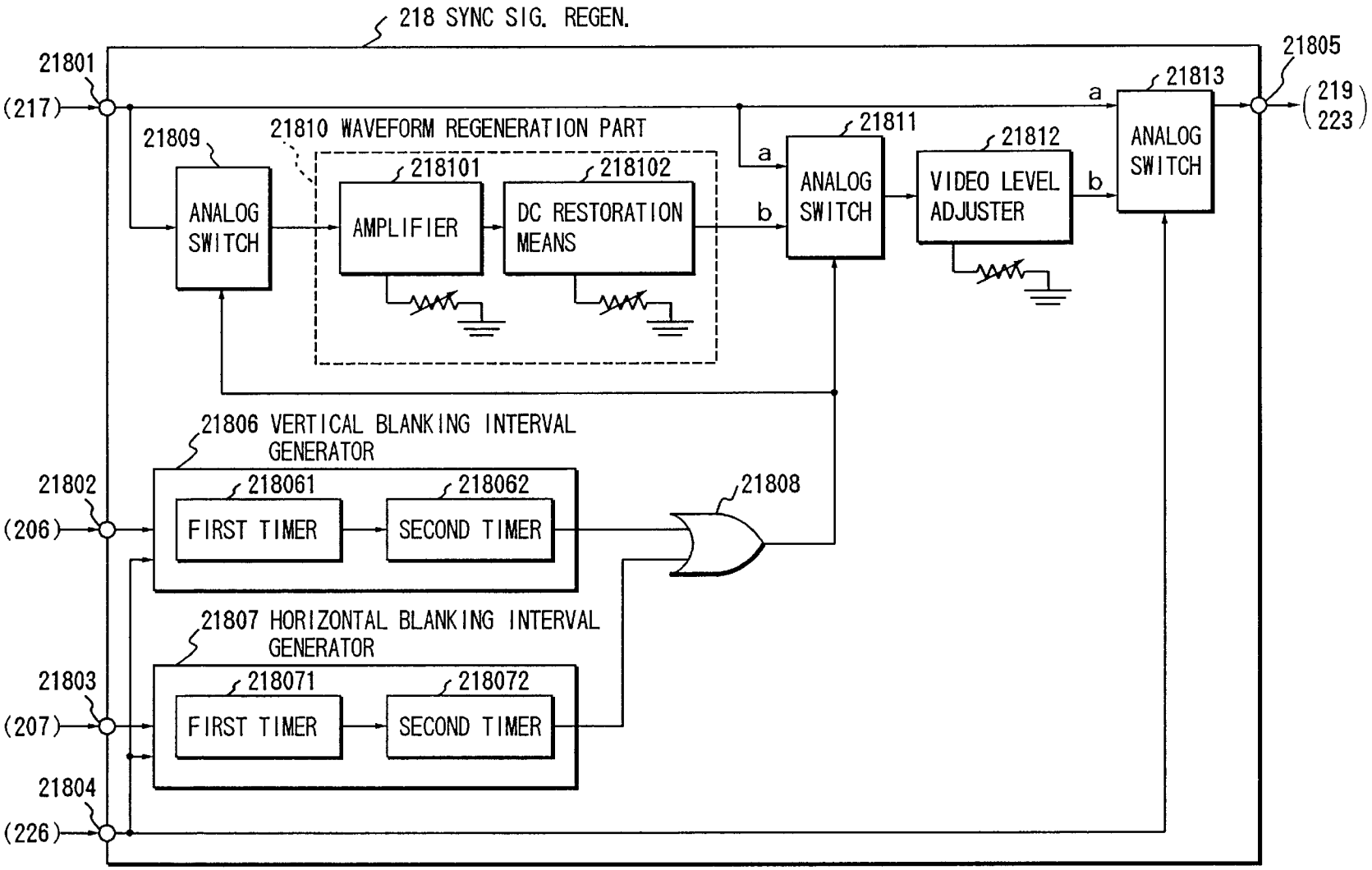
FIG. 15 is a block diagram illustrating an example of the configuration of a suppressed sync signal quasi-regenerator.

Turning next to FIG. 15, an example of the suppressed sync signal quasi-regenerator 218 has, as input terminals: a terminal 21801 for the video signal from the image receiver 217 of the monitoring apparatus 201; a terminal 21802 for the vertical sync signal from the wave-shaping circuit 206; a terminal 21803 for the horizontal sync signal from the wave-shaping circuit 207; and a terminal 21804 for the control signal from the MPU 226 which is at the high level (logic "1") only while the image receiver 217 outputs the video signal on the pay or scrambled channel of the CATV broadcast but at the low level (logic "0") except for the above period. The circuit 218 has an output terminal from which the video signal is applied to the sync separation circuit 219 and the A-D converter/frame memory 223.

Further, the suppressed sync signal quasi-regenerator 218 has its internal configuration composed of: a vertical blanking interval generator 21806 which determines the vertical blanking period from the vertical sync signal applied to the terminal 21802 and generates a signal which is high (logic "1") only during the vertical blanking interval; a horizontal blanking interval generator 21807 which determines the horizontal blanking interval from the horizontal sync signal applied to the terminal 21803 and generates a signal which is high only during the horizontal blanking interval; an OR gate 21808 for ORing the vertical and horizontal blanking signals; an analog switch 21809 which permits the passage there through of the video signal from the terminal 21801 only while the output from the OR gate 21808 is high; a waveform regeneration part 21810 by which the waveform of the video signal having passed through the analog switch 212809, that is, the waveforms of the signals during the vertical and horizontal blanking intervals, are restored to the original waveforms before they were scrambled; an analog switch 21811 which permits the passage there through of the output from the waveform regeneration part 21810 while the output from the OR gate is high, and permits the passage there through of the video signal from the terminal 21801 while the output from the OR gate 21809 is low; a video level adjuster 21812 for adjusting the level of the whole signal having passed through the analog switch 21811; and an analog switch 21813 which permits the passage there through of the output from the video level adjuster 21812 to the terminal 21805 while the signal applied to the terminal 21804 is high, and permits the passage there through of the video signal from the terminal 21801 to the terminal 21805 while the signal applied to the terminal 21804 is low.

The vertical blanking interval generator 21806 comprises first and second timers 218061 and 218062, and the horizontal blanking interval generator 21807 also comprises first and second timers 218071 and 218072. The waveform regeneration part 21810 comprises an amplifier 218101 with a volume control and a DC restoration means 218102 similarly equipped with a volume control.

A description will be given below of the operation of such a suppressed sync signal quasi-regenerator 218 of this embodiment.

When the reference video signal for comparison with the video signal selected by the analog switch 215 for the determination of the currently selected channel is not the video signal on the pay channel. of the CATV broadcast, the MPU 226 makes low the signal which is applied to the terminal 21804. In this situation, the video signal applied to the terminal 21801 passes through the analog switch 21813 intact to the terminal 21805. Accordingly, the video signals of the VHF/UHF, BS and CSTV channels and the video signal of the unscrambled CATV channel, which are generated by the image receiver 217 of the monitoring apparatus 201, are not subjected to any processing in the suppressed sync signal quasi-regenerator 218 but are output therefrom to the sync separation circuit 219 and the A-D converter/frame memory 223.

When the video signal for comparison with the video signal selected by the analog switch 215 is the video signal on the pay channel of the CATV broadcast, the MPU 226 makes high the signal that is applied to the terminal 21804. As a result, the video signal on the scrambled CATV channel, generated by the image receiver 217, is processed by the circuit 218 as described below.

With the signal to the terminal 21804 made high, the vertical and horizontal blanking interval generators 21806 and 21807 start, and generate the vertical and horizontal blanking signals.

Figure 16:
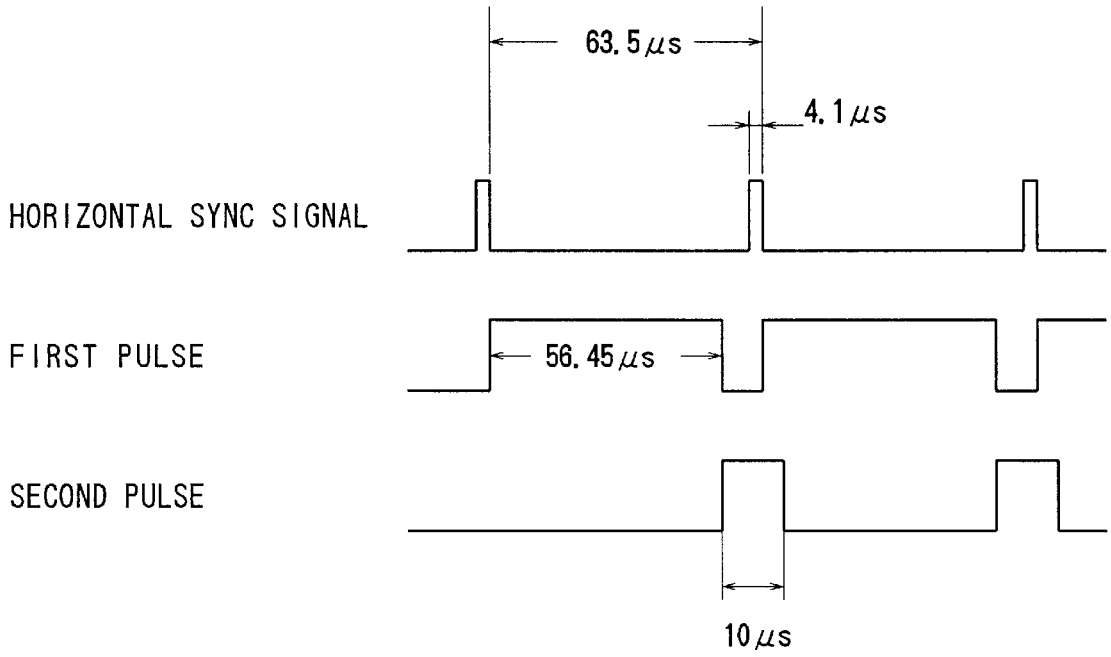
FIG. 16 is a timing chart for explaining the operation of a horizontal blanking interval generator.

FIG. 16 is a timing chart for explaining the operation of the horizontal blanking interval generator 21807. The first timer 218071 in the horizontal blanking interval generator 21807 is initiated by the trailing edge of the horizontal sync signal applied to the terminal 21803, and generates a first pulse which remains high for a 56.45 $\mu$S period. Next, the second timer 21807 is initiated by the trailing edge of the first pulse, and generates a second pulse which remains high for a 10 $\mu$S period. The second pulse is provided as the horizontal blanking signal to the OR gate 21808. On the same principle as mentioned above, the vertical blanking interval generator 21806 also generates a vertical blanking signal of a 1.5 mS pulse width indicative of the vertical blanking interval. In the OR gate 21808 the horizontal and vertical blanking signals are ORed with each other, and the OR is provided to the analog switches 21809 and 21811.

Figure 17A:
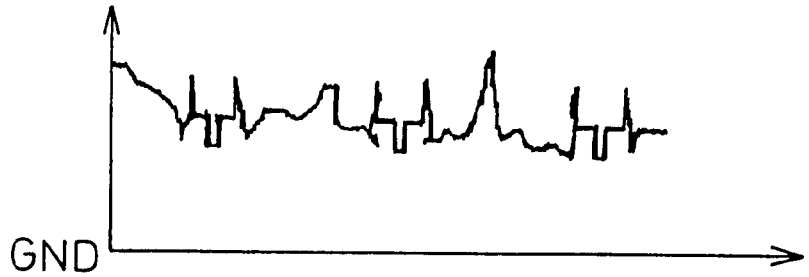
FIGS. 17A, 17B, 17C and 17D are waveform signals showing, by way of example, a scrambled video signal for input to the suppressed signal quasi-regenerator, an OR signal of horizontal and vertical blanking interval signals, a signal of a sync signal portion extracted from the scrambled video signal, and a restored sync signal, respectively.
Figure 17B:
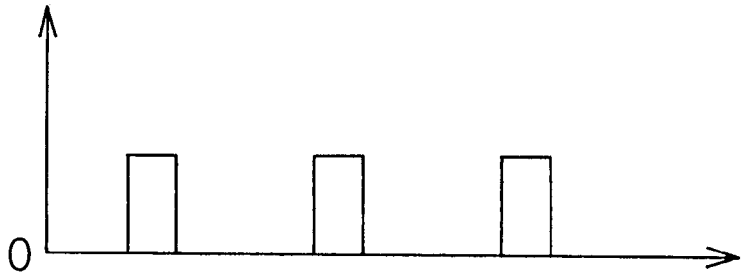
Figure 17C:
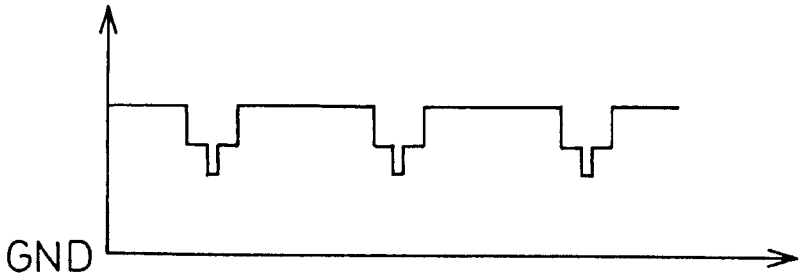
Figure 17D:
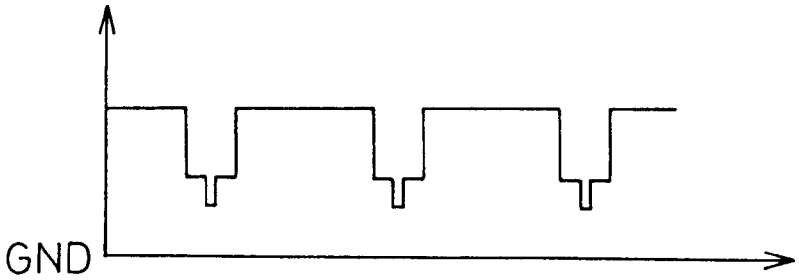

FIG. 17A depicts a scrambled video signal which is applied to the analog switch 21809 from the terminal 21801, FIG. 17B a signal which is applied to the analog switch 21809 from the OR gate 21808, FIG. 17C a signal which is output from the analog switch 21809, and FIG. 17D an example of the output signal from the waveform restoration part 2181. As shown, the analog switch 21809 outputs the scrambled video signal while the signal output from the OR gate is high, that is, the analog switch 21809 extracts and outputs signals during the horizontal and vertical blanking intervals. The waveform restoration part 21810 adjusts the levels of the signals and the heights of the sync signal pulses. By preadjustment of the amplifier 218101 and the DC restoration means 218102 with the volume controls at the time of installment of the monitoring apparatus 201, the signal states in the horizontal and vertical blanking intervals can be restored to the original states before scrambling.

Figure 18A:
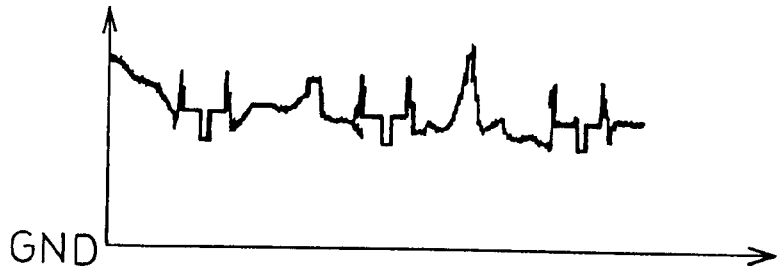
FIGS. 18A, 18B, 18C and 18D are waveform signals showing, by way of example, a scrambled video signal for input to the suppressed signal quasi-regenerator, an OR signal of horizontal and vertical blanking interval signals, a restored sync signal, and a descrambled video signal, respectively.
Figure 18B:
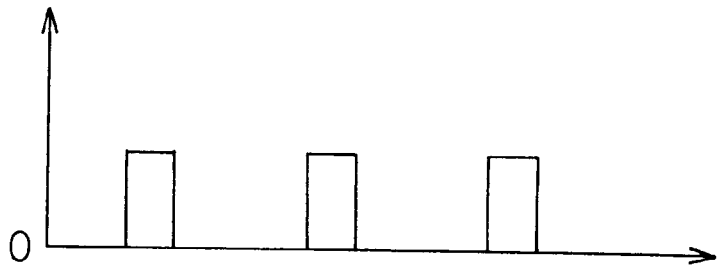
Figure 18C:
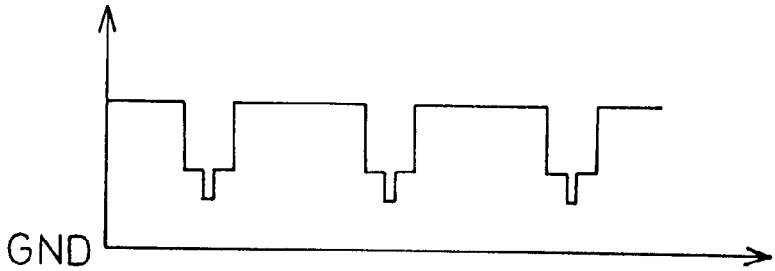
Figure 18D:
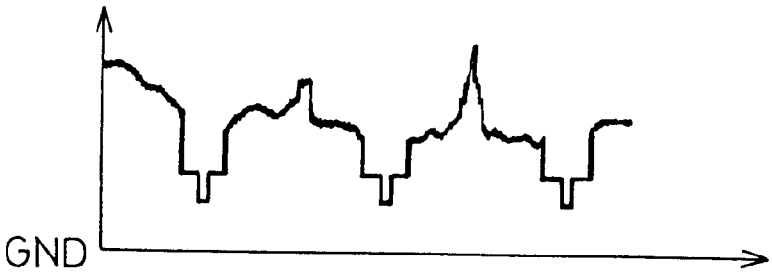

FIG. 18A shows a scrambled video signal which is fed to the analog switch 21811 from the terminal 21801, FIG. 18B a signal which is fed to the analog switch 21811 from the OR gate 211808, FIG. 18C a restored signal which is fed to the analog switch 21811 from the waveform regenerating part 21180, and FIG. 18D an example of the output signal from the analog switch 21811. The scrambled video signal depicted in FIG. 18A is the video signal on the same channel as the CATV channel currently viewed on the TV set 101. As shown in FIG. 18, the analog switch 21811 generates an unscrambled signal by combining part of the unscrambled video signal during the high-level period of the signal from the OR gate 21808 and the output signal from the waveform regenerating part 21810 during the low-level period of the signal from the OR gate 21808.

The unscrambled signal thus produced is amplified by the video level adjuster 21812, and output via the analog switch 21813 from the terminal 21805.

As described above, according to the suppressed sync signal quasi-regenerator of this embodiment, the vertical and horizontal sync signals of the video signal displayed on the TV screen are used to specify the vertical and horizontal blanking intervals, and only those signal portions of the scrambled video signal generated by the reference image receiver which correspond to the abovesaid vertical and horizontal blanking intervals are descrambled to form the video signal for comparison. Hence, it is possible to provide a unique identification of the currently selected channel by the direct comparison of the video signals even for CATV channels scrambled by the suppression-of-sync-signal scheme.

Next, an embodiment of the scanning system identifying circuit 224 will be described below.

Figure 19:
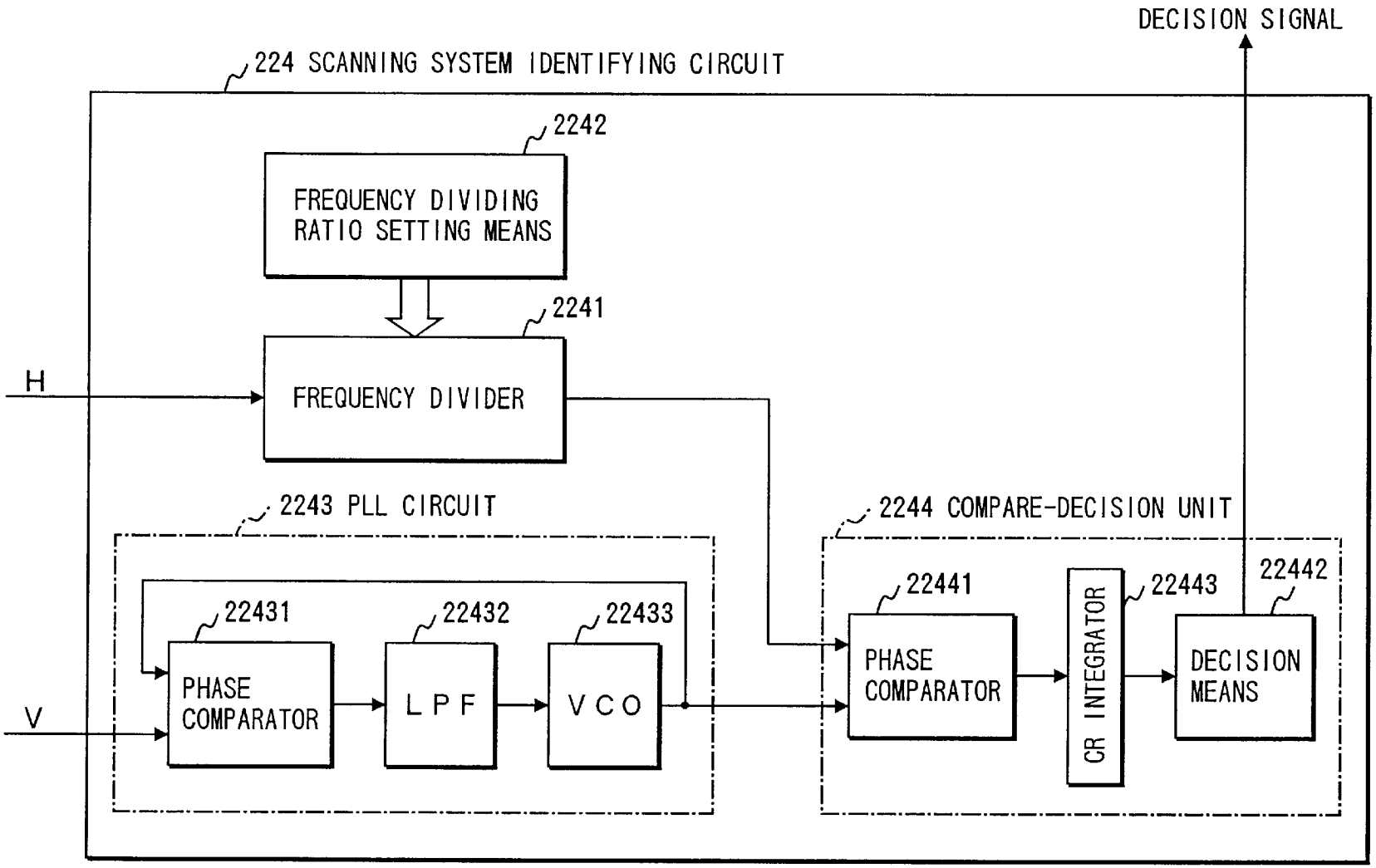
FIG. 19. is a block diagram illustrating an example of the configuration of a scanning system identifying circuit.

FIG. 19 illustrates in block form an example of the configuration of the scanning system identifying circuit 224. This embodiment comprises: a frequency divider 2241 for frequency dividing the horizontal sync signal H available from the wave-shaping circuit 207 in FIG. 2B; a frequency dividing ratio setting means 2242 for setting in the frequency divider 2241 a frequency dividing ratio fit for the electronic game machine 105; a PLL circuit 2243 for stabilizing the vertical sync signal V available from the wave-shaping circuit 206 in FIG. 2B; and a compare-decision unit 2244 which compares the phase of the vertical sync signal V stabilized by the PLL circuit 2243 and the phase of the horizontal sync signal H frequency-divided by the frequency divider 2241 and outputs a decision signal to the MPU 226 in FIG. 2B. The PLL circuit 2243 is made up of phase comparator 22431, an LPF (Low-Pass filter) 22432, and a VCO (Voltage-Controlled Oscillator) 22433. The compare-decision unit 2244 is composed of a phase comparator 22441, a decision means 22442, and a CR integrator 22443.

Figure 20A:
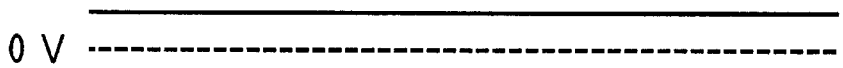
FIGS. 20A to 20B are diagrams showing an example of the output signal from a CR integrator in the scanning system identifying circuit when the actually selected source is equipment of the non-interlaced scanning system, and an example of the output from the CR integrator in the scanning system identifying circuit when the actually selected source is equipment of the interlaced scanning system.
Figure 20B:
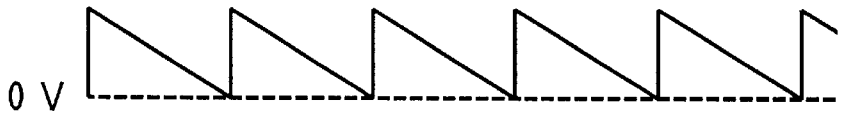

When the repetitive frequencies Fh and Fv of the horizontal and vertical sync signals in the video signal of the electronic game machine 105 in FIG. 2A bear a non-interlaced relationship Fh=262×Fv, a frequency dividing ratio 262 is set in the frequency divider 2241. With this setting, when the horizontal and vertical sync signals H and V in output video of the electronic game machine 105 played back in the TV set 101 are applied to the scanning system identifying circuit 224 after being wave-shaped by the wave-shaping circuits 207 and 206, respectively, the horizontal sync signal H is frequency divided down to $1/262$ and consequently has the same frequency as that of the vertical sync signal. As the result of this, the output signal from the CR integrator 22443, which is supplied with the phase-compared output from the phase comparator 22441, is substantially constant (but its value is variable) as depicted in FIG. 20A. On the other hand, in ordinary TV broadcast waves the repetitive frequencies of the horizontal and vertical sync signals H and V bear an interlaced relationship Fh=262.5×Fv. When the TV broadcast wave is received and played back in the TV set 101, its horizontal and vertical sync signals H and V are applied to the scanning system identifying circuit 224 after being wave-shaped by the wave-shaping circuits 207 and 206, and the horizontal sync signal H is frequency divided down to $1/262$, but in this case, its frequency does not become equal to the frequency of the vertical sync signal V. On this account, the output signal from the CR integrator 22443 varies just like a sawtooth waveform at a certain frequency (0.11 Hz that is the difference between the repetitive frequency 59.94 Hz of the vertical sync signal of the TV broadcast wave and a frequency 60.05 Hz obtained by frequency dividing the repetitive frequency 15.734 kHz of the horizontal sync signal down to 1/262) as depicted in FIG. 20B. Thus, by detecting the difference between the two sync signals by the decision means 22442, it is possible to determine if the scanning system of the video signal currently played back in the TV set 101 is non-interlaced or not, that is, whether it is a video signal of the TV broadcast wave or the electronic game machine 105.

While the scanning system identifying circuit 224 has been described to frequency divide the horizontal sync signal H, it may also be configured to multiply the vertical sync signal V. In this instance, the scanning system identifying circuit 224 is made up of: a multiplier for multiplying the vertical sync signal; a multiplication factor setting means which, when the repetitive frequencies Fh and Fv of the horizontal and vertical sync signals in the video signal of the electronic game machine 105 of the non-interlaced scanning system bear a relationship Fh=n×Fv (where n is a positive integer), sets the value n as the multiplication factor of the frequency multiplier; and a compare-decision unit which compares the phase of the output signal from the frequency multiplier and the phase of the horizontal sync signal and identifies the scanning system of the video signal as non-interlaced or interlaced, depending upon whether the phases of the vertical and horizontal sync signals coincide with each other.

The scanning system could also be identified through utilization of the relation Fh=262.5×Fv between the repetitive frequencies Fh and Fv of the horizontal and vertical sync signals in the video signal of the ordinary TV broadcast wave. In this case, however, since the frequency demultiplication or multiplication factor cannot be set at a value which has a decimal fraction, such as "262.5," the above relation is expanded to Fh×m(262.5×m)×Fv (where m is a positive even integer), and this relation is used to determine whether the scanning system of the video signal currently played back on the TV set 101 is non-interlaced or interlaced. In this instance, the scanning system identifying circuit 224 comprises: a frequency demultiplier for frequency demultiplying the horizontal sync signal by 262.5×m; a frequency demultiplier for frequency demultiplying the vertical sync signal by m, where m is a value equal to the above-said value m; and a compare-decision unit which compares the phases of the output signals from the both frequency demultipliers, and determines whether the scanning system of the video signal is interlaced or non-interlaced, depending on whether the phases of the both output signals coincide with each other or not. Alternatively, the circuit 224 comprises: a frequency multiplier for frequency multiplying the vertical sync signal by 262.5×m; a frequency multiplier for frequency multiplying the horizontal sync signal by m equal to the abovesaid value m; and a comparedecision unit which compares the phases of the output signals from the both frequency multipliers, and determines whether the scanning system of the video signal is interlaced or non-interlaced, depending on whether the phases of the both output signals coincide with each other or not.

While in the above the preferred embodiments of the present invention has been described, the invention is not limited specifically thereto but various variations can be made. For example, in the embodiment depicted in FIGS. 2A and 2B, the video signal played back on the cathode-ray tube 116 of the TV set 101 has been described to be demodulated by the PIF amplifier/demodulator circuit 208, but when the TV set 101 has a monitor video output terminal for taking out the video signal generated by the VHF/UHF tuner 115, the video signal may be provided via the output terminal to the monitoring apparatus 201. In this instance, by providing a sync separation circuit for separating vertical and horizontal signals from the taken-out video signal and supplying them, it is possible to omit the H- and V-sync sensors 203 and 202 and the wave-shaping circuits 206 and 207.

It will be apparent that many modifications and variations may be effected without departing from the scope of the novel concepts of the present invention.

What is claimed is:

1. A method for monitoring the channel selecting status of a TV set which has a plurality of video/audio sources built-in and at least one video/audio input terminal for inputting video and audio signals from at least one external video/audio source, said TV set being capable of providing a display and an acoustic output of video and audio signals supplied from a user's arbitrarily selected one of said video/audio sources, said method comprising the steps of:

(a) detecting vertical and horizontal sync signals of a video signal applied to a cathode-ray tube of said TV set;

(b) detecting video signals output from said plurality of video/audio sources built in said TV set;

(c) detecting a video signal output from said video/audio source connected to said video/audio input terminal of said TV set;

(d) sequentially selecting said video signals detected in said steps (b) and (c);

(e) separating vertical and horizontal sync signals from each of said video signals sequentially selected in said step (d);

(f) measuring the time difference between said vertical and horizontal sync signals detected in said step (a) and said vertical and horizontal sync signals selected in said step (e);

(g) correcting said time difference measured in said step (f) in accordance with a premeasured delay time inherent in each of said plurality of video/audio sources, and determining that one of said video/audio sources for which said corrected time difference is minimum is the video/audio source currently selected by said user;

(h) controlling a plurality of reference receivers to sequentially generate video signals of channels receivable from that one of said video/audio sources which was determined to be currently selected by said user in said step (g), said plurality of reference receivers being capable of generating video signals of each channel of each TV broadcast independently of said TV set;

(i) separating vertical and horizontal sync signals from each of said video signals generated in said step (h);

(j) measuring the time difference between vertical and horizontal sync signals of said video/audio sources determined to be currently selected by said user in said step (g) and said vertical and horizontal sync signals separated in said step (i); and (k) correcting said time difference measured in said step (i) in accordance with a premeasured delay time inherent in each of said plurality of video/audio sources, and determining that a channel for which said corrected time difference is smaller than a predetermined threshold value is a candidate for a channel currently selected by said user.

2. The method of claim 1, which further comprises the steps of:

(l) when a plurality of channels are determined as candidates for said user's currently selected channel in said step (k), controlling said plurality of reference receivers to sequentially generate video signals of the same channels as said candidate channels; and (m) comparing, at a plurality of sample points common thereto, a video signal generated from that one of said video/audio sources determined to be currently selected by said user in said step (g) and video signals sequentially generated in said step (l), and detecting said user's currently selected channel based on the degree of coincidence between said video signals.

3. The method of claim 2, which further comprises the step of:

(n) when said video/audio source connected to said video/audio input terminal of said TV set is a CATV tuner for CATV broadcast reception use, quasi-descrambling that one of video signals from a CATV receiver provided as said reference receiver which is of a pay channel scrambled by the suppression of sync signal.

4. The method of claim 3, wherein said step (n) comprises the steps of:

(n-1) generating vertical and horizontal blanking intervals from said vertical and horizontal sync signals detected in said step (a);

(n-2) extracting signals in said vertical and horizontal blanking intervals in said scrambled video signal;

(n-3) restoring said extracted signals to their original form before said video signal was scrambled; and (n-4) replacing said signals in said vertical and horizontal blanking intervals in said scrambled video signal with said restored signals to form descrambled video signals.

5. The method of claim 2, which further comprises the step of:

(o) determining, based on said vertical and horizontal sync signals detected in said step (a), whether the scanning system of said video signal applied to said cathode-ray tube is an interlaced or non-interlaced scanning system, and in the latter case, determining that preset equipment of the non-interlaced scanning system is the currently user's selected video/audio source.

6. An apparatus for monitoring the channel selecting status of a TV set which has a plurality of video/audio sources built-in and at least one video/audio input terminal for inputting video and audio signals from at least one external video/audio source, said TV set being capable of providing a display and an acoustic output of the video and audio signals supplied from a user's arbitrarily selected one of said video/audio sources, said apparatus comprising:

sync signal detecting means for detecting vertical and horizontal sync signals of a video signal applied to a cathode-ray tube of said TV set;

internal video signal detecting means for detecting video signals output from said plurality of video/audio sources built in said TV set;

external video signal detecting means for detecting a video signal output from said video/audio source connected to said video/audio input terminal of said TV set;

an analog switch which is supplied with said video signals detected by said internal video signal detecting means and said video signal detected by said external video signal detecting means, and selectively outputs one of said video signals;

first sync separating means for separating vertical and horizontal sync signals from said video signal output from said analog switch;

time difference measuring means which is supplied with first and second vertical and horizontal sync signals, and measures the time differences between said first and second vertical sync signals and between said first and second horizontal sync signals;

control means which: inputs said vertical and horizontal sync signals detected by said sync signal detecting means, as said first vertical and horizontal sync signals, to said time difference measuring means; inputs said vertical and horizontal sync signals separated by said first sync separating means from said video signal of each of said video/audio sources selectively fed thereto from said analog switch, as said second vertical and horizontal sync signals, to said time difference measuring means; measures, by said time difference measuring means, the time differences between said vertical and horizontal sync signals detected by said sync signal detecting means and said vertical and horizontal sync signals of said each video/audio source; corrects said measured time differences in accordance with a premeasured delay time inherent in said each video/audio source; and determines that one of said video/audio sources for which said corrected time difference is minimum is the video/audio source currently selected by said user;

a plurality of reference receivers for generating video signals of each channel of each TV broadcast independently of said TV set;

second sync separating means for separating vertical and horizontal sync signals from each of said video signals generated by said reference receivers; and a selector for selectively outputting either said vertical and horizontal sync signals detected by said sync signal detecting means or said vertical and horizontal sync signals separated by said second sync separating means;

wherein said control means: inputs a video signal of said that one of video/audio source determined as being currently selected by said user, to said first sync separating means via said analog switch inputs vertical and horizontal sync signals separated by said first sync separating means, as said first vertical and horizontal sync signals, to said time difference measuring means; sequentially generates, by said reference receivers, video signals of respective channels receivable from that one of said video/audio sources determined as currently selected by said user, and applies said video signals to said second sync separating means one by one; inputs vertical and horizontal sync signals separated by said second sync separating means, as said second vertical and horizontal sync signals, to said time difference measuring means; measures, by said time difference measuring means, the time differences between vertical and horizontal sync signals output from that one of said video/audio sources determined as currently selected by said user and vertical and horizontal sync signals of each channel generated by said reference receivers; corrects said measured time differences in accordance with a premeasured delay time inherent in said each of said plurality of video/audio sources; and determines that a channel for which said corrected time difference is smaller than a predetermined threshold value is a candidate for a channel currently selected by said user.

7. The apparatus of claim 6, which further comprises:

a first A-D converter/frame memory for digitizing and storing said video signal output from said analog switch; and a second A-D converter/frame memory for digitizing and storing said video signals output from said reference receivers;

wherein when a plurality of channels are determined as candidates for said user's currently selected channel by the comparison of said sync signals, said control means: controls said plurality of reference receivers to sequentially generate video signals of the same channels as said candidate channels, and inputs said video signals to said second A-D converter/frame memory; stores in said first A-D converter/frame memory a video signal generated by that one of said video/audio sources determined as the source currently selected by said user; compares those video signals at a plurality of sample points common thereto; and detects said user's currently selected channel based on the degree of coincidence between said video signals.

8. The apparatus of claim 7, which further comprises:

a CATV receiver as one of said reference receivers; and a suppressed sync signal quasi-regenerator which quasi-descrambles that one of video signals from said CATV receiver which is of a pay channel scrambled by the suppression of sync signal.

9. The apparatus of claim 8, wherein said suppressed sync signal quasi-regenerator comprises:

interval generating means for generating vertical and horizontal blanking intervals from said vertical and horizontal sync signals detected by said sync signal detecting means signal extracting means for extracting signals in said vertical and horizontal blanking intervals in said scrambled video signal generated by said CATV receiver;

sync signal restoring means for restoring said extracted signals to their original form before said video signal was scrambled; and video signal generating means for replacing said signals in said vertical and horizontal blanking intervals in said scrambled video signal from said CATV receiver with said restored signals from said sync signal restoring means to form descrambled video signals.

10. The apparatus of claim 8, which further comprises:

a scanning system identifying circuit for determining, based on said vertical and horizontal sync signals detected by said sync signal detecting means, whether the scanning system of said video signal applied to said cathode-ray tube is an interlaced or non-interlaced scanning system, and wherein when the scanning system of said video signal is the non-interlaced scanning system, said control means determines that preset equipment of the non-interlaced scanning system is the video/audio source currently selected by said user.

* * * * *